US008290198B2

(12) United States Patent
Ogasawara et al.

(10) Patent No.: US 8,290,198 B2
(45) Date of Patent: Oct. 16, 2012

(54) SPEAKER DEVICE

(75) Inventors: Yasuaki Ogasawara, Tendo (JP); Koji Maekawa, Tendo (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 230 days.

(21) Appl. No.: 12/921,738

(22) PCT Filed: Mar. 19, 2009

(86) PCT No.: PCT/JP2009/055527

§ 371 (c)(1),
(2), (4) Date: Sep. 9, 2010

(87) PCT Pub. No.: WO2010/106686

PCT Pub. Date: Sep. 23, 2010

(65) Prior Publication Data

US 2011/0051988 A1 Mar. 3, 2011

(51) Int. Cl.
*H04R 25/00* (2006.01)

(52) U.S. Cl. ..... 381/396; 381/401; 181/163

(58) Field of Classification Search ..... 381/396, 381/398, 400, 403, 404, 405, 407, 412, 419, 381/420, 421, 422, 430, 432, 431, 399, 190, 381/191, 408, 418; 181/157, 161, 163, 165
See application file for complete search history.

(56) References Cited

U.S. PATENT DOCUMENTS 6,563,933 B1 * 5/2003 Niederdraenk ..... 381/417
7,415,125 B2 * 8/2008 Warren et al. ..... 381/418
2011/0069859 A1 * 3/2011 Kobayashi et al. ..... 381/400
2011/0116650 A1 * 5/2011 Umetsu et al. ..... 381/86
2011/0158462 A1 * 6/2011 Horigome et al. ..... 381/413
2011/0164781 A1 * 7/2011 Horigome et al. ..... 381/398
2011/0176703 A1 * 7/2011 Horigome et al. ..... 381/412

(Continued)

FOREIGN PATENT DOCUMENTS

JP 63-250995 A 10/1988

(Continued)

OTHER PUBLICATIONS

Patent Abstract of Japan Publication No. 07-203589, Publication date Aug. 4, 1995 (1 page).

(Continued)

*Primary Examiner* — Davetta W Goins
*Assistant Examiner* — Phylesha Dabney
(74) *Attorney, Agent, or Firm* — Osha Liang LLP

(57) ABSTRACT

A speaker device includes a pair of diaphragms disposed opposite each other, a frame configured to vibratably support an outer periphery of the diaphragms in a vibration direction, and a plurality of driving parts configured to support a rear surface of each of the diaphragms and vibrate the diaphragms in response to an audio signal. The plurality of the driving parts include a pair of magnetic circuits in which a magnetic gap is formed in a direction different from the vibration direction of the diaphragms, a pair of voice coils vibratably arranged in the magnetic gap in one axis direction, vibrating so as to move toward or away from each other in response to the audio signal, and a rigid vibration direction converter part direction-converting the vibration of the voice coils and transmitting the vibration to the diaphragms.

25 Claims, 16 Drawing Sheets

U.S. PATENT DOCUMENTS

| | | | | |
|---|---|---|---|---|
| 2011/0200204 | A1* | 8/2011 | Horigome et al. | 381/86 |
| 2011/0232990 | A1* | 9/2011 | Kobayashi et al. | 181/157 |
| 2011/0305355 | A1* | 12/2011 | Horigome et al. | 381/162 |
| 2012/0051557 | A1* | 3/2012 | Horigome et al. | 381/86 |
| 2012/0106772 | A1* | 5/2012 | Horigome et al. | 381/398 |
| 2012/0114136 | A1* | 5/2012 | Horigome et al. | 381/86 |

FOREIGN PATENT DOCUMENTS

| | | | |
|---|---|---|---|
| JP | 64-54899 | A | 2/1989 |
| JP | 07-203589 | | 8/1995 |
| JP | 8-149596 | | 6/1996 |
| JP | 2005-159698 | A | 6/2005 |

OTHER PUBLICATIONS

Patent Abstracts of Japan Publication No. 08-149596, Publication date Jun. 7, 1996, (1 page).
International Search Report w/translation from PCT/JP2009/055527 dated Apr. 21, 2009 (2 pages).
Written Opinion w/translation from PCT/JP2009/055527 dated Apr. 21, 2009 (6 pages).
International Preliminary Report on Patentability from PCT/JP2009/055527 dated Sep. 20, 2011 (8 pages).
espacenet Abstract Publication No. JP2005159409A dated Jun. 16, 2005 (1 page).

* cited by examiner

Prior Art

SPEAKER DEVICE

FIELD OF THE INVENTION

The present invention relates to a speaker device.

BACKGROUND OF THE INVENTION

A dynamic speaker device is known as a typical speaker device (for example, see patent literature 1). The dynamic speaker device, for example, as shown in FIG. 1, includes a frame 3J, a cone-shaped diaphragm 21J, an edge 4J through which the diaphragm 21J is supported by the frame 3J, a voice coil bobbin 610J joined to the inner periphery part of the diaphragm 21J, a damper 7J through which the voice coil bobbin 610J is supported by the frame 3J, a voice coil 611J wound around the voice coil bobbin 610J, a yoke 51J, a magnet 52J, a plate 53J, and a magnetic circuit having a magnetic gap in which the voice coil 611J is arranged. In this speaker device, when an audio signal is inputted to the voice coil 611J, the voice coil bobbin 610J vibrates by a Lorentz force developed in the voice coil 611J in the magnetic gap and the diaphragm 21J is driven by the vibration.

[Patent literature 1] Publication of unexamined patent application H8-149596 (FIG. 1)

SUMMARY OF THE INVENTION

The typical dynamic type speaker device as described above is configured such that the voice coil 611J is disposed opposite to the sound emission side of the diaphragm 21J and the vibration directions of the voice coil 611J and the voice coil bobbin 610J are the same as the vibration direction of the diaphragm 21J, for example, as shown in FIG. 1. In the speaker device as configured above, a region for vibration of the diaphragm 21J, a region for vibration of the voice coil bobbin 610J, and a region for arranging the magnetic circuit, etc. are necessarily formed in the vibration direction (sound emission direction) of the diaphragm 21J. Accordingly, the total height of the speaker device necessarily becomes comparatively large.

Specifically, as shown in FIG. 1, the dimension of the above-mentioned speaker device in the vibration direction of the diaphragm 21J includes (a) the total height of the cone-shaped diaphragm 21J in the vibration direction and the edge 4J through which the diaphragm 21J is supported by the frame 3J, (b) the height of the voice coil bobbin from the joining part of the diaphragm 21J and the voice coil bobbin 610J to the upper end of the voice coil 611J, (c) the total height of the voice coil, (d) the height mainly of the magnet of the magnetic circuit, corresponding to the height from the lower end of the voice coil 611J to the upper end of the yoke 51J, (e) the thickness mainly of the yoke 51J of the magnetic circuit, etc. The speaker device as described above requires sufficient heights of the above-mentioned (a), (b), (c), and (d) to ensure a sufficient vibration stroke of the diaphragm 21J. Further, the speaker device requires sufficient heights of the above-mentioned (c), (d), and (e) to secure a sufficient electromagnetic force. Accordingly, particularly in a speaker device adapted to a large sound volume, the total height of the speaker device inevitably becomes large.

Since the vibration direction of the voice coil bobbin 610J is the same as that of the diaphragm 21J in the conventional speaker device as described above, the total height of the speaker device inevitably becomes large to secure a vibration stroke of the voice coil bobbin 610J, when seeking a large volume sound with large amplitude of vibration of the diaphragm 21J. Thus, it becomes difficult to make a thin device. In other words, the problem is that making a thin device and securing a loud sound are contradictory to each other.

However, it is preferable to directly transmit the vibration of the voice coil 611J to the diaphragm 21J, more specifically to align the vibration direction of the voice coil 611J with the vibration direction of the diaphragm 21J in order to efficiently transmit the vibration of the voice coil 611J to the diaphragm 21J. If the vibration direction of the voice coil 611J is different from the vibration direction of the diaphragm 21J, the vibration of the voice coil 611J may not securely transmitted to the diaphragm 21J, which may cause degradation of reproducing efficiency of the speaker device. In particular, it is required to securely transmit the vibration of the voice coil 611J to the diaphragm in order to realize preferable property in high frequencies.

On the other hand, in a typical dynamic type speaker device, a voice coil bobbin 610J is joined to the inner periphery part of the cone shaped diaphragm 21J and a driving force is transmitted from the voice coil bobbin 610J to the inner periphery part of the diaphragm 21J, and thus it is comparatively difficult to drive the whole diaphragm substantially in the same phase. As such, a speaker device, which can drive the whole diaphragm substantially in the same phase, is desired.

Further, a diaphragm with large diameter (large area) is required for loud sound in low frequencies. If the voice coil bobbin 610J is only connected to a point near the center portion of the diaphragm as in the conventional art, the driving force generated by the voice coil 611J is required to be comparatively strong. A large sized magnetic circuit is required for the strong driving force, and thus the speaker device cannot be made thin. Although a cone shaped large area diaphragm may be rigid, a divided vibration is prone to occur if it is driven by a single voice coil bobbin 611J, and thus it is difficult to generate high-quality reproduction in wide frequencies. Furthermore, in the conventional art, a magnetic circuit vibrates due to reaction from a vibration system and this vibration may be transmitted through the frame to a mounting part of the speaker, which may generate unwanted sounds.

On the other hand, there is known a speaker device that has a plurality of diaphragms and emits sounds in different directions with each diaphragm. For example, if two of the speaker devices shown in FIG. 1 are integrated with the diaphragms facing directions opposite each other for the speaker device as shown in the publication of unexamined patent application H7-203589, the thickness that is approximately twice as large as the total height of the above-mentioned speaker device is required. In this configuration, since two magnetic circuits to drive both diaphragms are arranged in the proximity of each other, heat generated from the voice coils when driving both diaphragms is transmitted to the magnetic circuits. The magnetic circuits arranged in the proximity of each other may eventually heat up each other, thereby troubles such as heat loss of the voice coil, demagnetization of the magnetic circuit, etc. may occur.

It is an object of the present invention to overcome the problems described above. More specifically, an object of the present invention is to provide a thin speaker device capable of emitting a loud sound with a comparatively simple structure, a thin speaker device with high reproducing efficiency capable of securely transmitting the vibration of the voice coil to the diaphragm and a thin speaker device capable of emitting a reproduced sound with high sound quality with a comparatively simple structure. Further, it is an object of the present invention to provide a thin speaker device in which the diaphragm vibrates substantially in the same phase with a comparatively simple structure. Further, it is an object of the present invention to provide a thin speaker device in which the diaphragm vibrates substantially in the same phase with a comparatively simple configuration. It is an object of the present invention to provide a thin speaker device while having high-quality loud sound in low frequencies with a large area diaphragm. It is an object of the present invention to prevent unwanted sounds emitted from a mounting part of a speaker, etc., which is caused by vibration of the magnetic circuit that is generated by reaction from a vibration system and transmitted to the frame. It is an object of the present invention to prevent an adverse effect on each driving part due to heat in a speaker device, which has a driving part driving a pair of diaphragms that emit sounds in both directions.

In general, according to one aspect of the present invention, a speaker device includes a pair of diaphragms disposed opposite each other, a frame configured to vibratably support an outer periphery of the diaphragms in a vibration direction, and a plurality of driving parts configured to support a rear surface of each of the diaphragms and vibrate the diaphragms in response to an audio signal, wherein the plurality of the driving parts include: a pair of magnetic circuits in which a magnetic gap is formed in a direction different from the vibration direction of the diaphragms, a pair of voice coils vibratably arranged in the magnetic gap in one axis direction, vibrating so as to move toward or away from each other in response to the audio signal, and a rigid vibration direction converter part direction-converting the vibration of the voice coils and transmitting the vibration to the diaphragms, and the rigid vibration direction converter part has a hinge formed on a side of the pair of diaphragms and on a side of the opposing ends of the pair of voice coils, respectively, and a link part obliquely disposed with respect to the vibration direction of the voice coils.

DETAILED DESCRIPTION OF THE INVENTION

Figure 1:
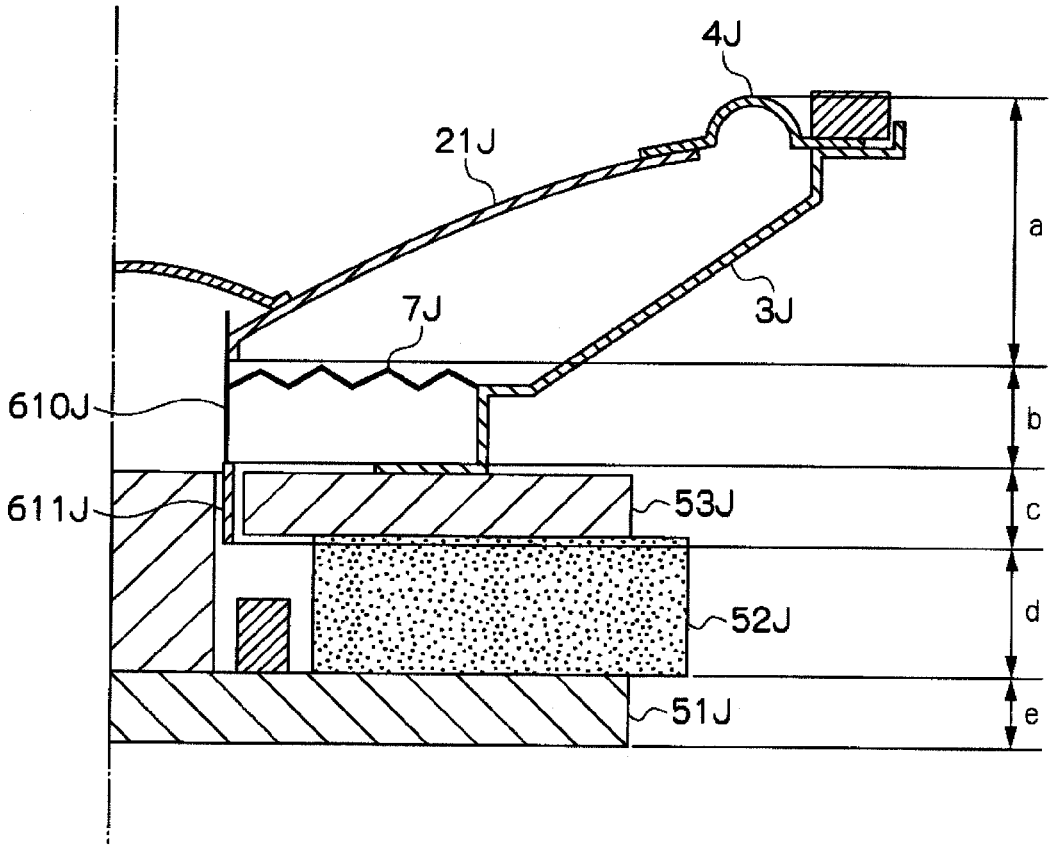
FIG. 1 is a view illustrating a speaker device of a prior art.

Hereinafter, an embodiment according to the present invention is described with reference to the drawings. The embodiment according to the present invention includes what is shown in the drawings, but is not limited to this alone. In the description hereinafter, the same symbol is applied to the same part as the part that has already been described, and thus a part of the same description may not be repeated.

Figure 2A:
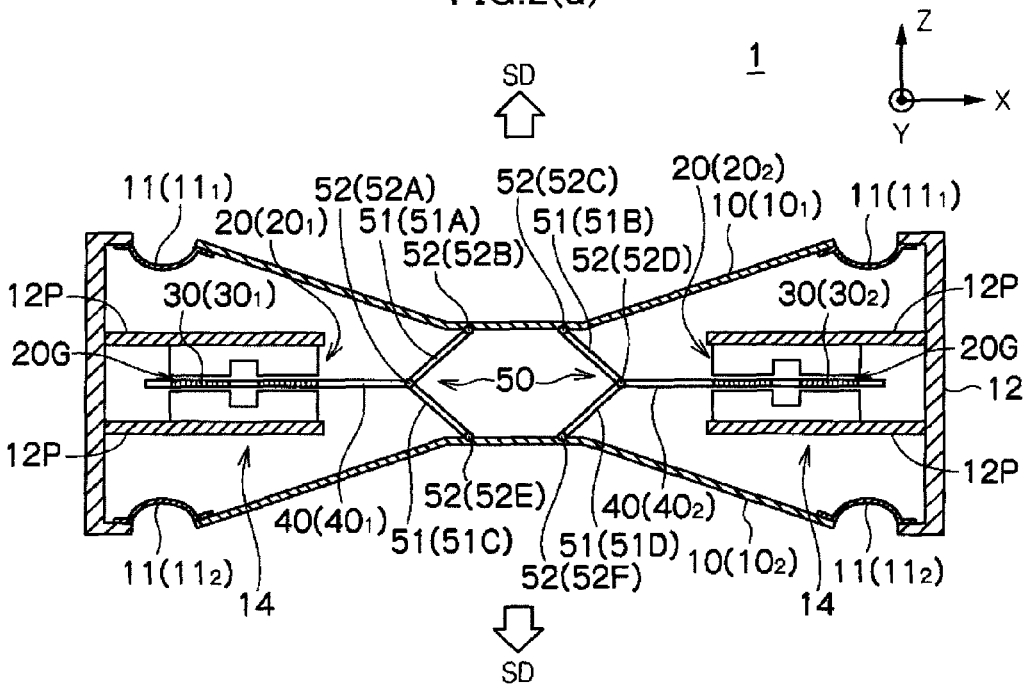
FIG. 2 is a view illustrating a whole configuration of the speaker device according to an embodiment of the present invention (FIG. 2(*a*) is a cross-sectional view taken along line A-A and FIG. 2(*b*) is a plan view)
Figure 2B:
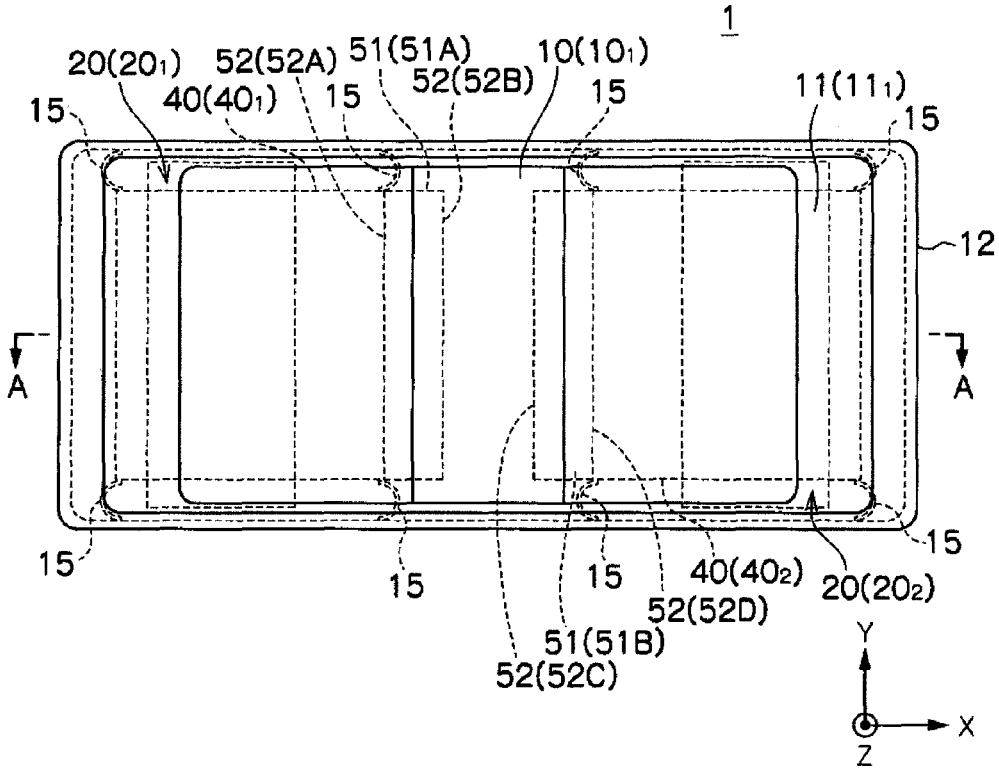
Figure 3A:
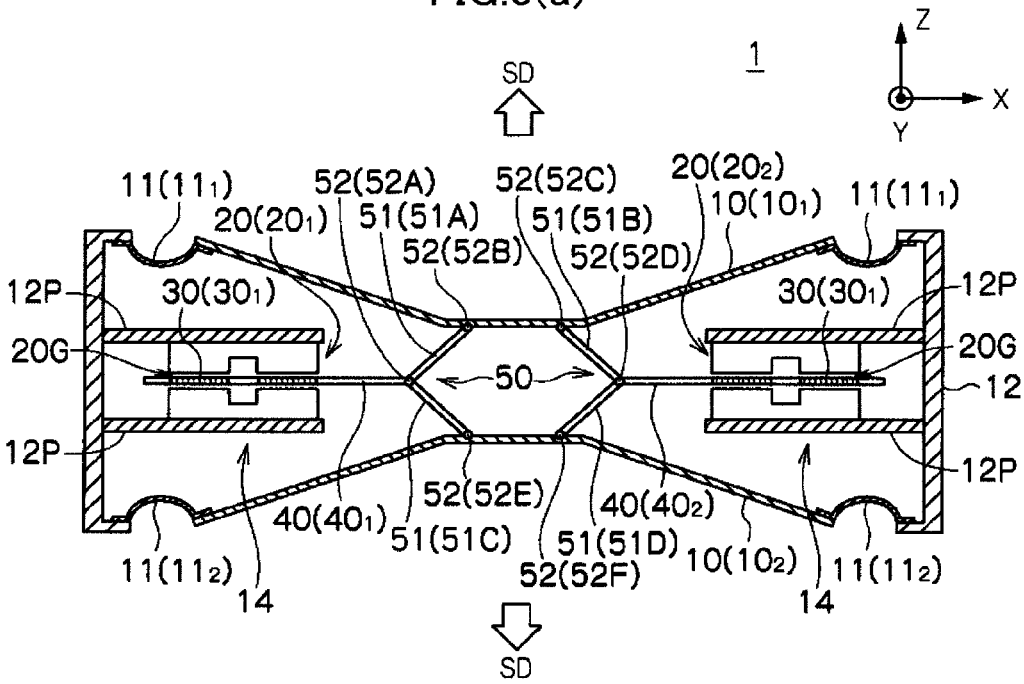
FIG. 3 is a view illustrating a whole configuration of the speaker device according to an embodiment of the present invention (FIG. 3(*a*) is a cross-sectional view taken along line A-A and FIG. 3(*b*) is a plan view)
Figure 3B:
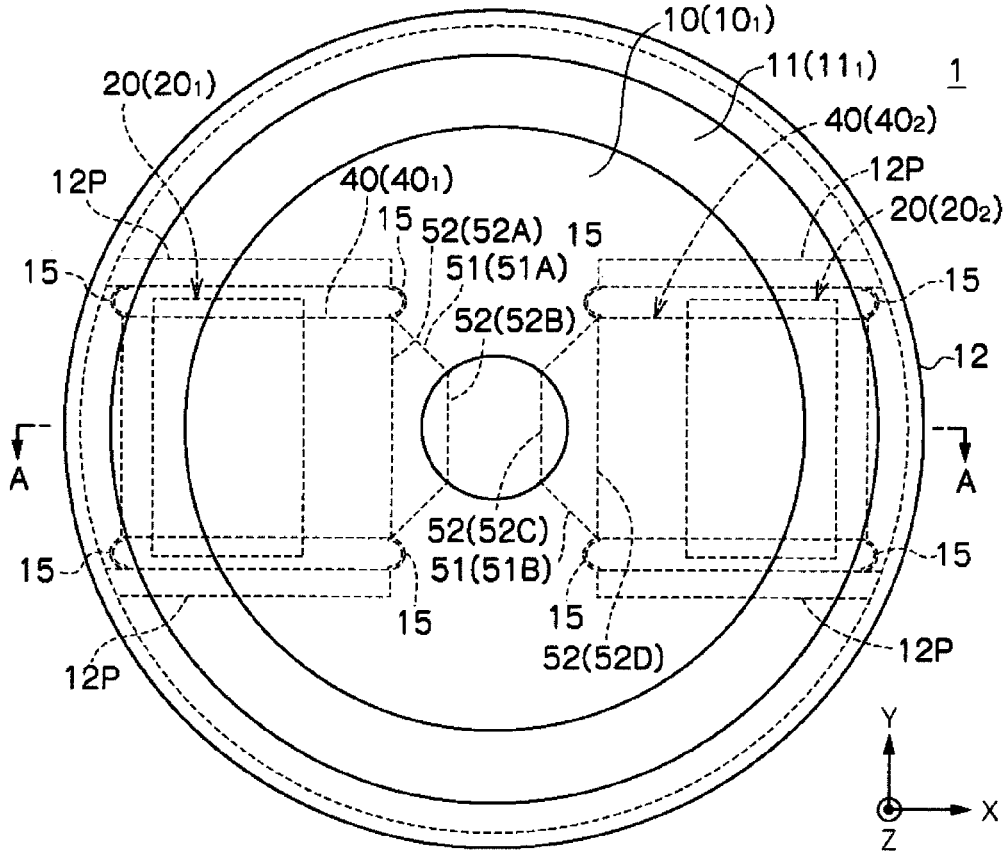

[Whole Configuration of Speaker Device: FIG. 2, FIG. 3]

FIGS. 2 and 3 are views illustrating a whole configuration of the speaker device according to an embodiment of the present invention (FIG. 2(*a*) is a cross-sectional view taken along line A-A and FIG. 2(*b*) is a plan view). A speaker device 1 includes a pair of diaphragms 10 (101, 102) disposed opposite each other, a frame 12 vibratably supporting the outer periphery of each diaphragm 10 (101, 102) in the vibration direction and a plurality of driving parts 14 configured to support the rear surface of each diaphragms 10 (101, 102) and to vibrate the diaphragms 10 (101, 102) in response to an audio signal. The driving part 14 includes a pair of magnetic circuits 20 (201, 202) in which a magnetic gap is formed in a direction different from the vibration direction of the diaphragms 10 (101, 102), a pair of voice coils 30 (301, 302) vibratably arranged in the magnetic gap along one axis direction, vibrating so as to move toward or away from each other in response to the audio signal and a rigid vibration direction converter part 50 direction-converting the vibration of the voice coils 30 (301, 302) and transmitting the vibration to the diaphragms 10 (101, 102). The vibration direction converter part 50 has a hinge 52 formed on the side of the pair of diaphragms and on the side of the opposing ends of the pair of voice coils and has a link part 51 obliquely disposed with respect to the vibration direction of the voice coils 30 (301, 302), and a plurality of the link parts 51 are symmetrically arranged with respect to two axes of the vibration direction of the voice coils 30 (301, 302) and the vibration direction of the diaphragms 10 (101, 102).

The diaphragms 10 (101, 102) are disposed opposite each other, emitting sounds in both sound emission directions SD, which are different from each other. Although the plan view of the embodiment shown in FIG. 2 is a rectangular shape, it may be circular, ellipsoidal or other shapes as shown in FIG. 3. Although the cross-sectional shape of the diaphragms 10 is substantially V-shape in the embodiment shown in the drawings (the embodiment shown in FIG. 2 is shaped by bending the diaphragm 10 at two bending parts near the central part while the embodiment shown in FIG. 3 has an inverted trapezoidal shape), it is not limited to this shape. The cross-sectional shape may be shaped by bending the diaphragms 10 at one bending part or by bending it in a U-shape.

The frame 12 supports vibrations of the diaphragms 10, the driving parts 14, etc., and vibratably supports the outer periphery of the diaphragm 10 in the vibration direction (for example, in Z-axis direction). The frame 12 supports the driving part 14 with an attaching portion 12P elongatedly formed from the side wall of the frame 12 to the center side of the diaphragm 10. The outer periphery of the diaphragms 10 (101, 102) is supported by the frame 12 via edges 11 (111, 112). Magnetic circuits 20 (201, 202) are attached to the attaching portion 12P. The voice coils 30 (301, 302) are held on the side wall of the frame 12 via a holding part 15 in the embodiment shown in FIG. 2. The voice coils 30 (301, 302) are held on the side surface of the attaching portion 12P via a holding part 15 in the embodiment shown in FIG. 3.

The driving part 14 has the magnetic circuits 20, the voice coils 30, and the vibration direction converter part 50. The voice coils 30 vibrate along the magnetic gap 20G of the magnetic circuits 20 in one axis direction, and the converter part 50 converts the direction of the vibration and transmit the vibration to the diaphragms 10. The voice coils 30 vibrate in the X-axis direction so as to move toward or away from each other as shown in the drawings. The diaphragm 10 is vibratably arranged in Z-axis direction orthogonally to X-axis direction. The vibration direction converter part 50 converts the vibration of the voice coils 30 (301, 302) moving toward or away from each other in the X-axis direction to the change in obliquely disposed angle in itself, and thus vibrating the diaphragms 10 (101, 102) in the Z-axis direction.

The voice coils 30 are formed by winding the conducting wire to which the audio signal is inputted. The voice coils 30 are vibratably arranged on the frame 12 in themselves or vibratably arranged on the frame 12 via a voice coil support part 40. The voice coil support part 40 may be formed, for example, with a tabular insulating member and the voice coils 30 are supported on the surface or inside the voice coil support part 40.

The holding part 15 is configured to vibratably hold the voice coils 30 or the voice coil support part 40 in the vibration direction (for example X-axis direction) and to prevent the voice coils 30 or the voice coil support part 40 from moving in other directions. For example, the holding part 15 is deformable in the vibration direction of the voice coils 30 (for example X-axis direction) and may be formed with a rigid curved plate member in a direction crossing the vibration direction.

The vibration direction converter part 50 has a plurality of link parts 51 (first link part 51A, second link part 51B, third link part 51C, fourth link part 51D) and a plurality of hinges 52 (52A, 52B, 52C, 52D, 52E, 52F). The link parts 51 and the hinges 52 may constitute a so-called pantograph mechanism. A plurality of link parts 51 are symmetrically arranged with respect to two axes of the vibration direction (X-axis direction) of the voice coils 301, 302 and the vibration direction (Z-axis direction) of the diaphragms 101, 102. The vibration direction converter part 50 has one end angle-variably coupled to the voice coils 30 directly or via other member, while the other end is coupled to the diaphragms 101, 102 directly or via other member. The vibration direction converter part 50 is obliquely disposed with respect to the vibration direction of the diaphragms 101, 102 and the vibration direction of the voice coils 30 respectively.

The inclination angle of each link parts 51 of the vibration direction converter part 50 changes as the voice coils 301, 302 vibrate so as to move toward or away from each other. As a result, the diaphragms 101, 102 vibrate in directions opposite each other. If the link parts 51 are directly coupled to the diaphragms 101, 102 with hinges 52B, 52C, 52E and 52F on the side of the diaphragms as shown in the drawings, the diaphragms 101, 102 must be rigid. If the link parts 51 are not directly coupled to the diaphragms 101, 102, rigid coupling parts are provided between the hinges 52B and 52C and between the hinges 52E and 52F on the side of the diaphragm, and the coupling parts are coupled to the diaphragms 101, 102 respectively.

In this speaker device 1, if the same audio signal is inputted to the voice coils 30 of a plurality of driving parts 14, each voice coil 301, 302 vibrates in the same planar direction (for example X-axis direction or Y-axis direction as illustrated) so as to move toward or away from each other. Upon this vibration, a pair of the diaphragms 101, 102, which are disposed opposite each other via vibration direction converter part 50 of each driving part 14, vibrate in a direction different from the vibration direction of the voice coils 30 (for example Z-axis direction as illustrated) so as to move toward or away from each other, and thus sounds are concurrently emitted in both sound emission directions SD different from each other.

In this speaker device 1, since a plurality of driving parts 14, which support the rear surface of the diaphragms 10 at a plurality of different points and generate vibrations in response to an audio signal, are provided, the diaphragms 10 may be integrally vibrated even if the aria of the diaphragms 10 is comparatively large. As such, generation of divided vibration of the diaphragms 10 may be restrained, and reproduction of high sound quality may be realized. In addition, high sound pressure in low frequencies may be secured with small amplitude of vibration even if area of the diaphragm 10 is comparatively large, and thus high-quality in low frequencies may be realized.

Further, since the voice coils 30 and the diaphragms 10 are configured to vibrate in different directions by using the converter part 50, the rear side part of the diaphragm may be made thinner than when the voice coils 30 are vibrated in the vibration direction of the diaphragms 10. As such, a thin speaker device capable of reproducing low frequency range with high sound pressure may be realized.

Furthermore, since the vibration direction of the voice coils 30 is converted and the vibration is transmitted to the diaphragms 10 by the vibration direction converter part 50, thickness in sound emission direction of the speaker device 1 (total height of speaker device) may not be large even if amplitude of vibration of the diaphragms 10 is large by large amplitude of vibration of the voice coils 30. As such, a thin speaker device capable of emitting a loud reproduced sound may be realized.

In addition, since the magnetic circuits 201, 202 of the driving parts 14 driving the diaphragms 101, 102 may be arranged spaced apart when emitting sounds in different directions from a pair of the diaphragms 101, 102 opposite each other, heat loss of the voice coil 30, demagnetization of the magnetic circuit 20, etc. due to heat generated by the voice coils 301, 302 may be restrained. Further, since the magnetic circuits 201, 202 may be arranged near the side wall of the frame 12, heat generated by the voice coils 301, 302 may be dissipated quickly via the frame 12, and thus heat generated when driving the speaker device may be prevented from having an adverse effect on both driving parts 14.

Since a pair of the diaphragms vibrates in directions opposite each other while a pair of the voice coils vibrates in directions opposite each other, reactions due to these vibrations cancel each other out. As such, troubles that the magnetic circuit, etc. vibrates by reactions due to vibration of a vibration system and an abnormal noise due to the vibration may be restrained. Further, since reactions of link parts cancel each other out, vibration of the diaphragm may be stabilized and high-quality reproduced sound may be generated.

[Magnetic Circuit/Voice Coil: FIGS. 4 to 7]

FIGS. 4 to 7 are views for illustrating a magnetic circuit and voice coil.

The magnetic circuit 20 vibrating the voice coil 30 forms the magnetic gap 20G in the vibration direction of the voice coil 30. The magnetic gap 20G forms a pair of magnetic fields opposite each other to exert a Lorentz force on the voice coil 30 by flowing current (audio current corresponding to audio signal) in the voice coil 30. As such, when an audio current flows in the voice coil 30, the voice coil 30 vibrates in the arrangement direction of the magnetic gap 20G in which a pair of the magnetic fields are generated.

The magnetic circuit 20, which is formed with the magnet 21 and the yoke 22, forms a pair of the magnetic gaps 20G side by side with a space in the X-axis direction. The magnetic gaps 20G form magnetic fields opposite each other in the Z-axis direction. The voice coil 30 is wound such that current flowing in each magnetic gap 20G flows opposite each other in the Y-axis direction, and thereby a Lorentz force in the X-axis direction exerts on the voice coil 30. The magnetic circuit 20 having the same function as that described above may be configured by arranging the magnet 21 and the yoke 22 in some different ways.

Figure 4:
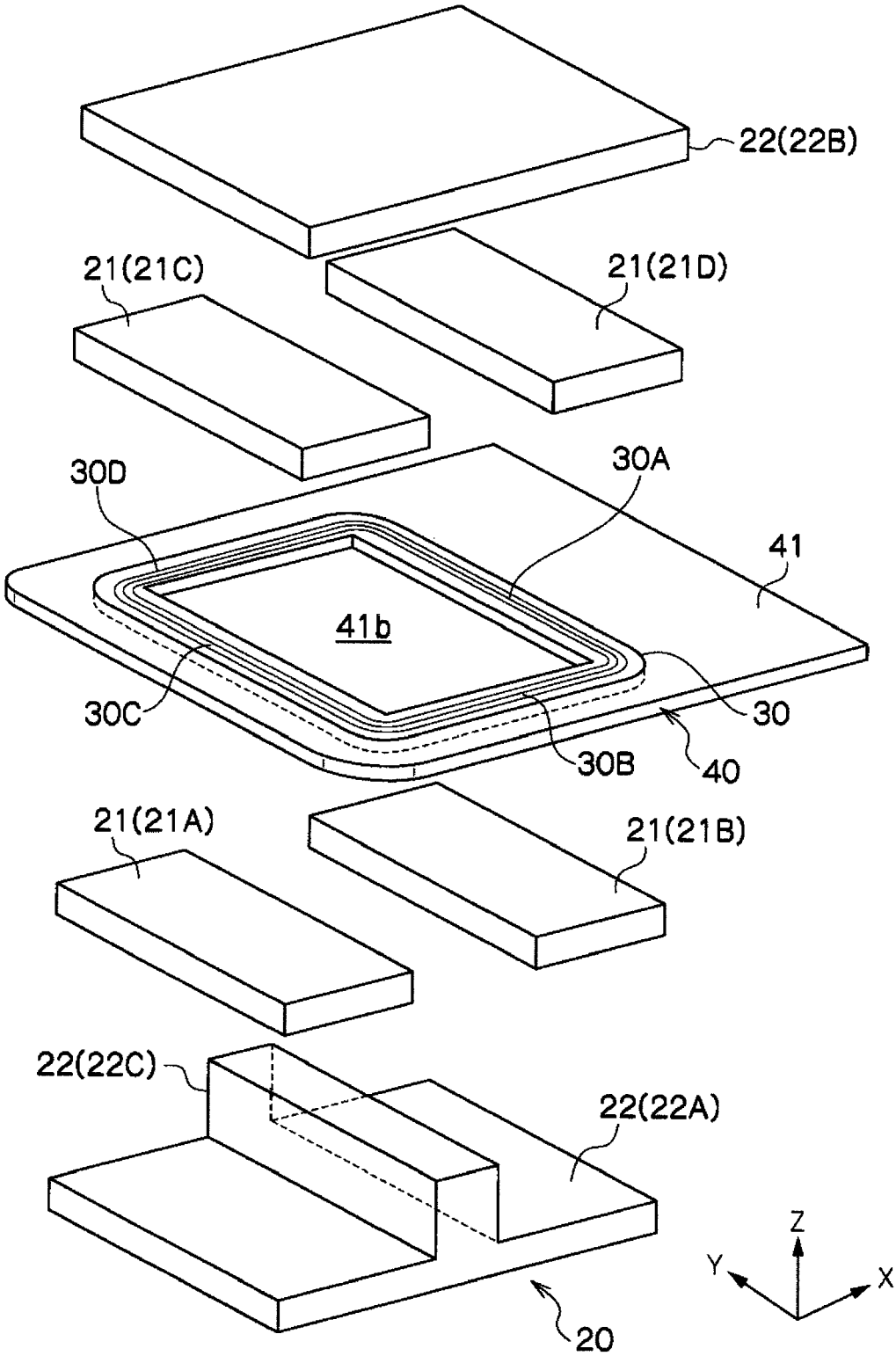
FIG. 4 is a view illustrating a magnetic circuit and a voice coil of the speaker device according to an embodiment of the present invention.
Figure 5:
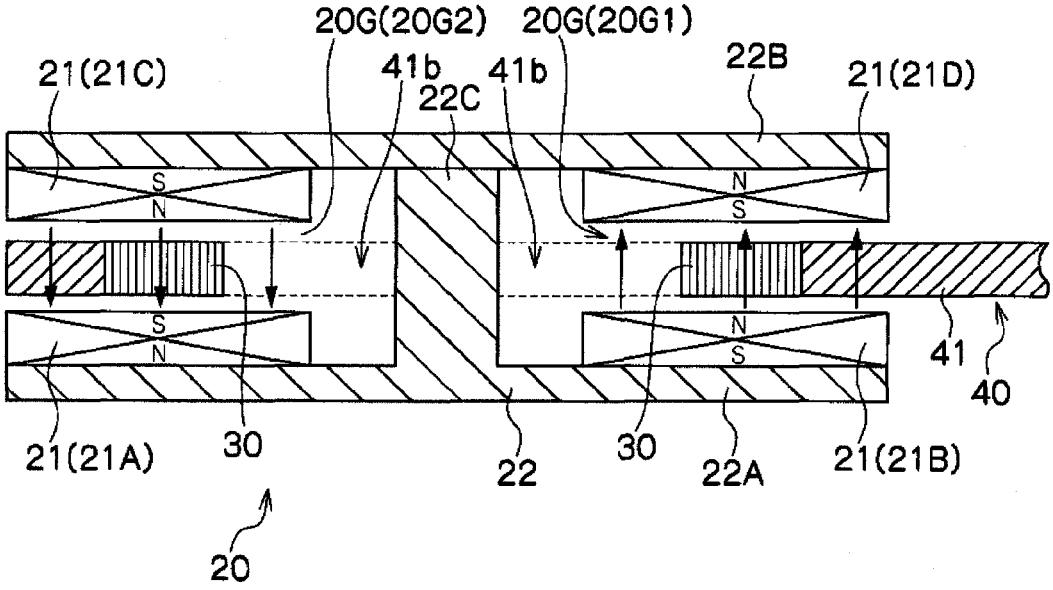
FIG. 5 is a view illustrating a magnetic circuit and a voice coil of the speaker device according to an embodiment of the present invention.

According to FIGS. 4 and 5, the magnetic circuit 20 includes a plurality of magnets 21 (21A to 21D). In this magnetic circuit 20, the magnets 21 are provided at both sides of the magnetic gap 20G in the direction of the magnetic field. In the example shown in the drawings, the yoke 22 includes a lower yoke 22A, an upper yoke 22B and a strut part 22C. The yokes 22A and 22B are arranged substantially in parallel with a prescribed space, and the strut part 22C is formed in the central part, extending in the direction substantially orthogonal to the yokes 22A and 22B.

The magnets 21A to 21D are arranged at the yokes 22A and 22B. One magnetic gap 20G2 is formed with the magnet 21A and the magnet 21C, while another magnetic gap 20G1 is formed with the magnet 21B and the magnet 21D. The pair of the magnetic gap 20G1 and the magnetic gap 20G2 are planarly formed side by side, and thus forming magnetic fields in the directions opposite each other.

On the other hand, the voice coil 30 has its planar shape formed substantially in a rectangular shape, and is configured with linear portions 30A and 30C formed in the Y-axis direction and linear portions 30B and 30D formed in the X-axis direction. The linear portions 30A and 30C of the voice coil 30 are arranged in each magnetic gap 20G of the magnetic circuit 20, and the direction of the magnetic field is prescribed to be in the Z-axis direction. The magnetic field is preferably not applied to the linear portions 30B and 30D of the voice coil 30. Further, the linear portions 30B and 30D are configured such that Lorentz forces, developing in the linear portions 30B and 30D, cancel each other out, even when the magnetic field is applied thereto. The voice coil 30 can be made comparatively large in a part arranged in the magnetic gap 20G by comparatively increasing the number of turns, and thus a comparatively large driving force may be produced when driving a speaker.

According to the example shown in the drawings, the voice coil 30 is supported by the voice coil support part 40 including a insulating flat plate 41 in which a hole 41*b* is formed. Also, the voice coil 30 with rigidity may be formed in a plate shape as a whole. When the voice coil 30 is provided with rigidity, no voice coil support part 40 may be employed.

According to the example of the magnetic circuit 20 shown in FIG. 4, the magnet 21A and the magnet 21C of a plurality of the magnets 21A to 21D are magnetized in the same direction, while the magnet 21B and the magnet 21D are magnetized in the same direction which is opposite to the magnet 21A and the magnet 21C such that the magnetic field applied to the linear portion 30A of the voice coil 30 is directed opposite to the magnetic field applied to the linear portion 30C. Although the magnet 21 can be magnetized after combining the magnet 21 and the yoke 22, two processes of magnetization are required for the example shown in FIGS. 4 and 5.

Figure 6:
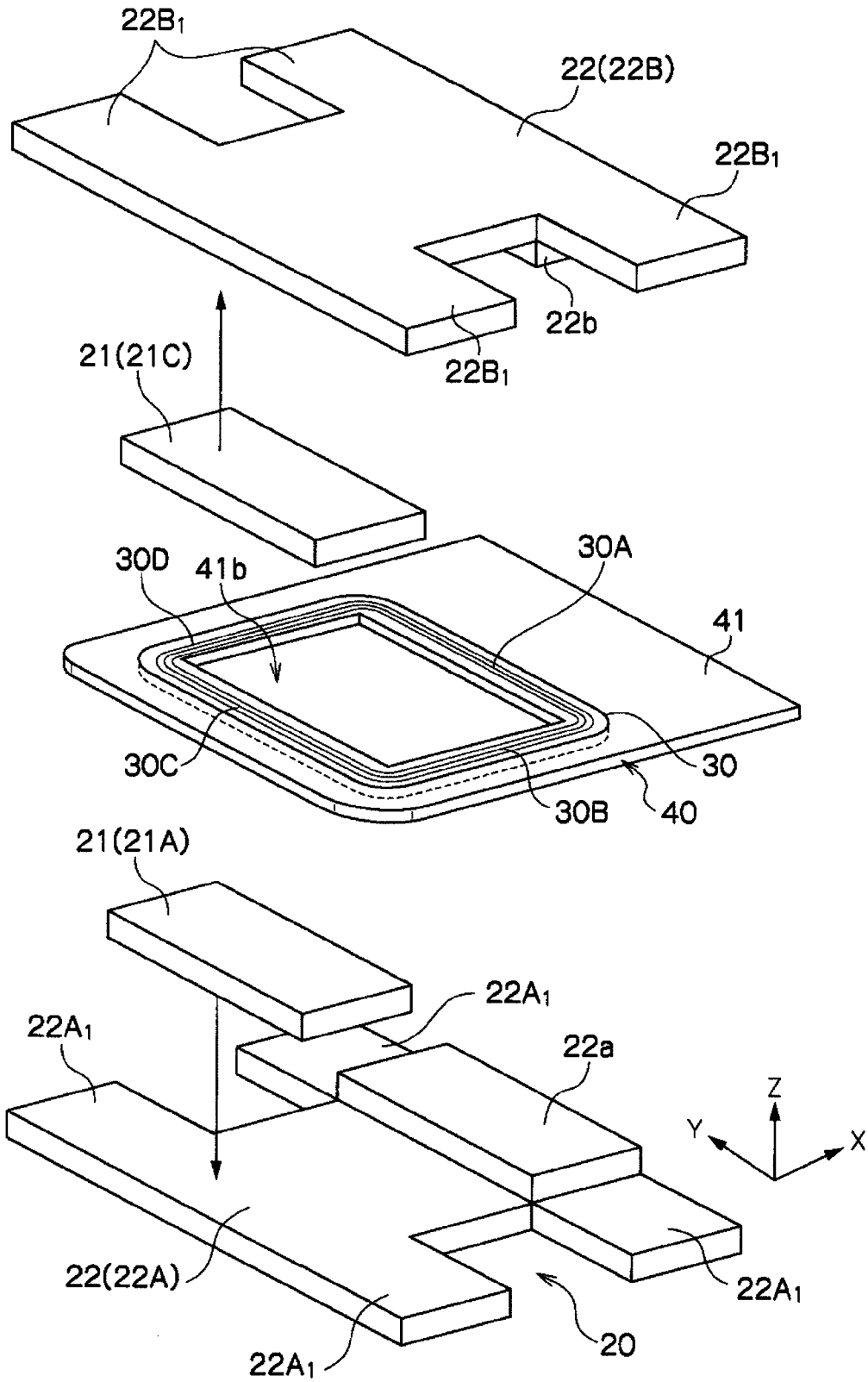
FIG. 6 is a view illustrating a magnetic circuit and a voice coil of the speaker device according to an embodiment of the present invention.
Figure 7:
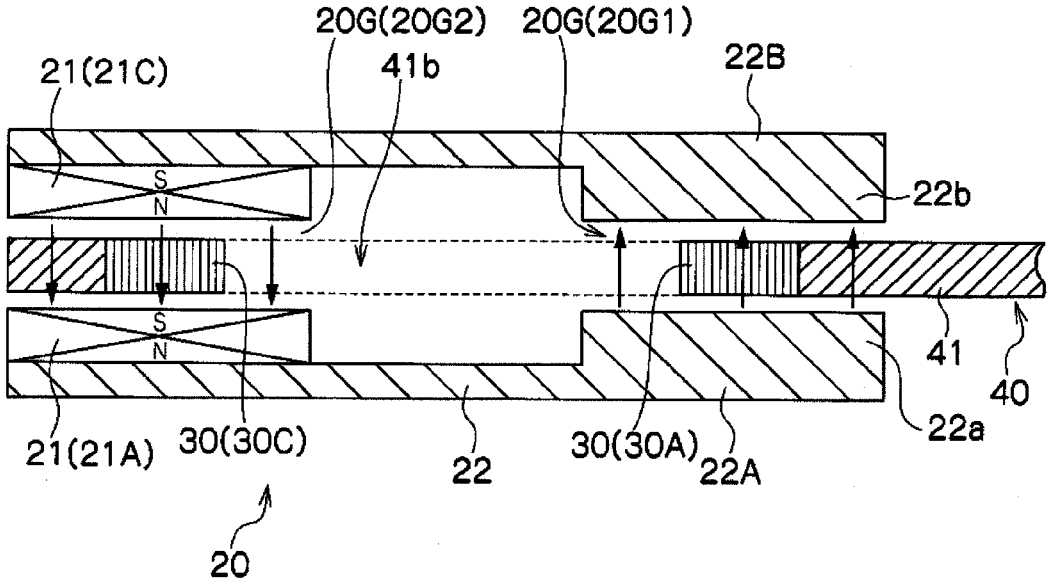
FIG. 7 is a view illustrating a magnetic circuit and a voice coil of the speaker device according to an embodiment of the present invention.

By contrast, in the example shown in FIGS. 6 and 7, the magnetic gap 20G2 is formed with magnets 21A and 21C magnetized in the same direction, while the magnetic gap 20G1 is formed between yoke convex portions 22*a* and 22*b* formed in the yokes 22A and 22B respectively. According to this configuration, a process of magnetization after combining the magnet 21 and the yoke 22 may be one time, and thus the process may be simplified.

Further, in the example shown in the drawings, support parts $\mathbf{22}A_1$ and $\mathbf{22}B_1$, positioning and supporting the yoke 22 at the attaching portion 12P, etc. are formed at the yoke 22 in itself. According to this configuration, the above strut part 22C may be eliminated, and space of the magnetic gap 20G is prescribed by positioning the yoke 22 to the attaching portion 12P.

Figure 8A:
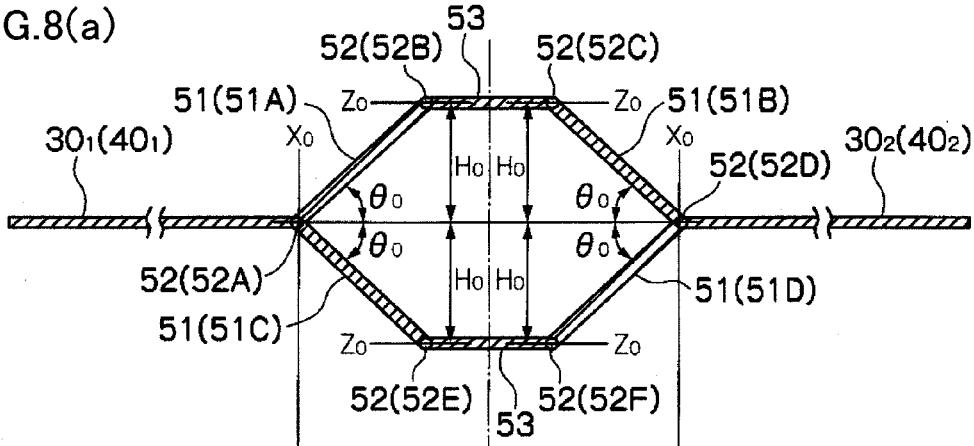
FIGS. 8(*a*)-(*c*) are views illustrating a configuration example and an operation of the vibration direction converter part of the speaker device according to an embodiment of the present invention.
Figure 8B:
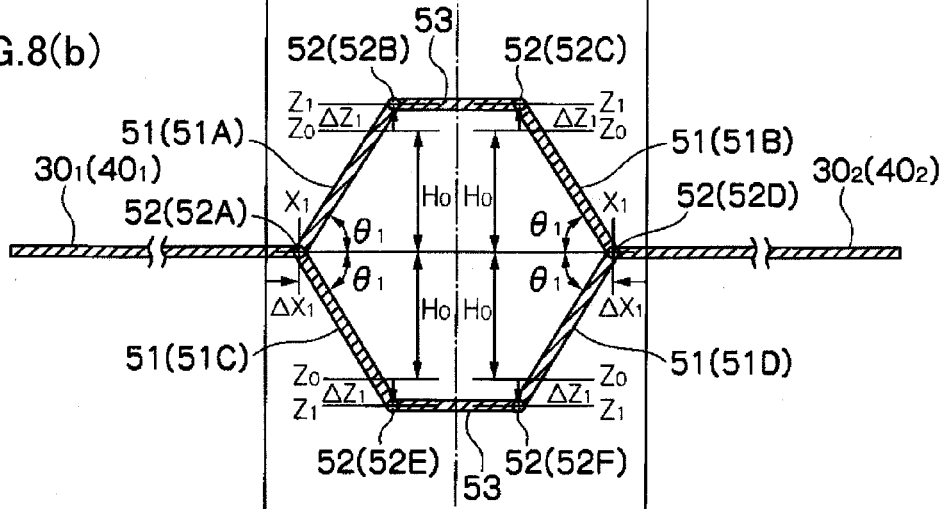
Figure 8C:
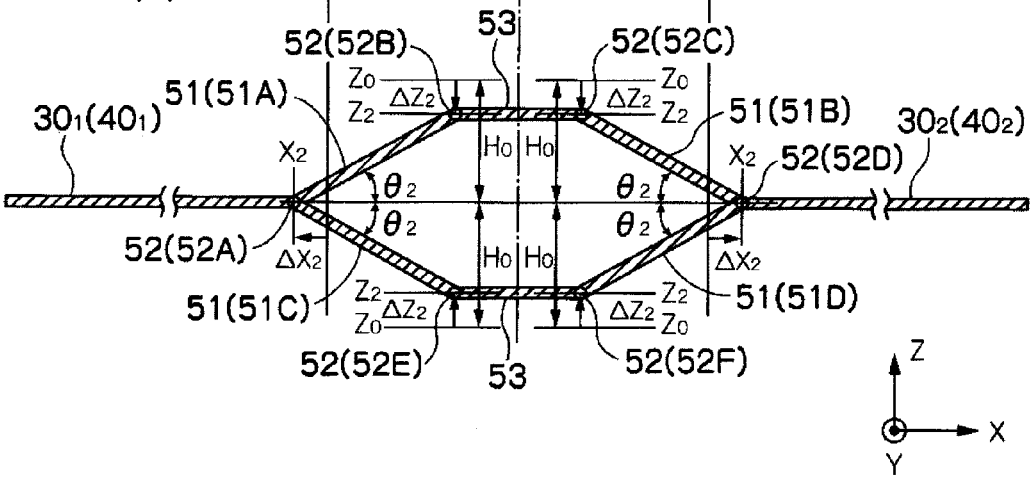
Figure 9A:
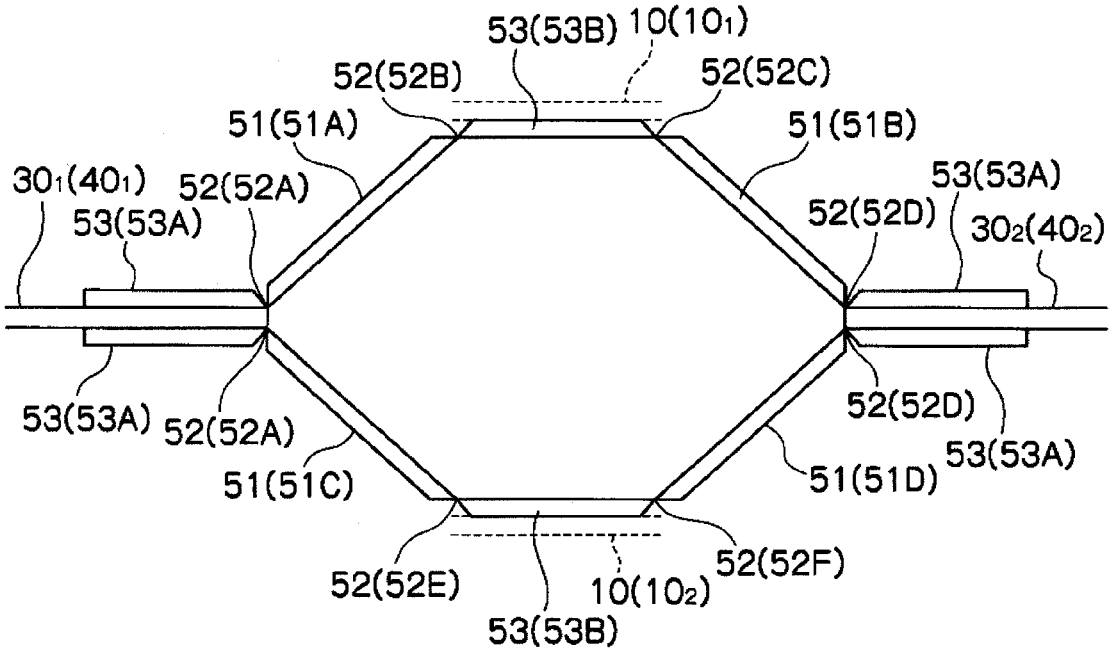
FIG. 9 is a view illustrating a formation example of the vibration direction converter part of the speaker device according to an embodiment of the present invention (FIG. 9(*a*) is a side view and FIG. 9(*b*) is a perspective view)
Figure 9B:
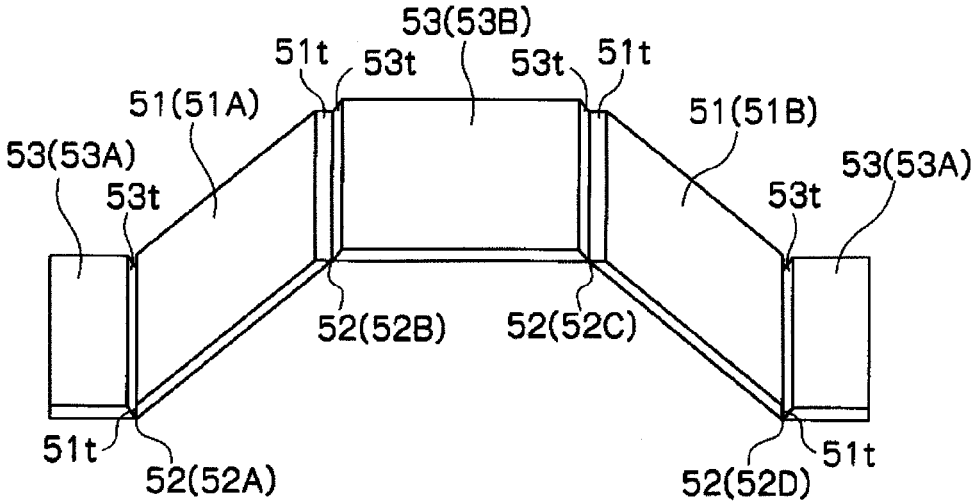
Figure 10A:
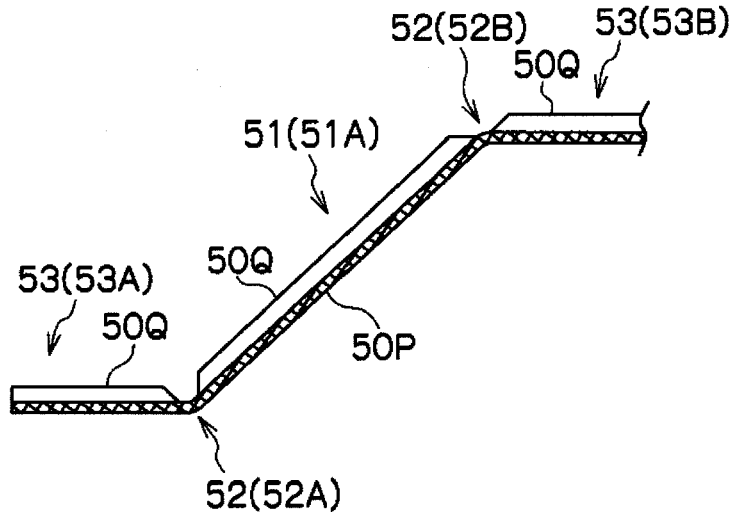
FIGS. 10(*a*)-(*c*) are views illustrating a formation example of the vibration direction converter part of the speaker device according to an embodiment of the present invention.
Figure 10B:
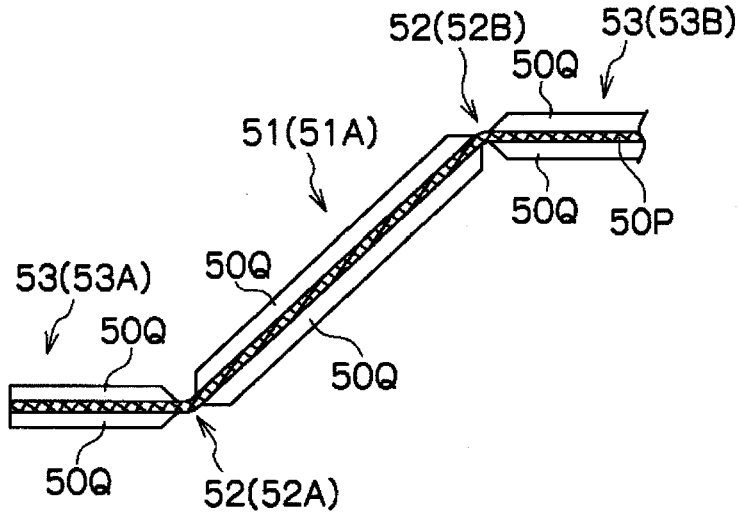
Figure 10C:
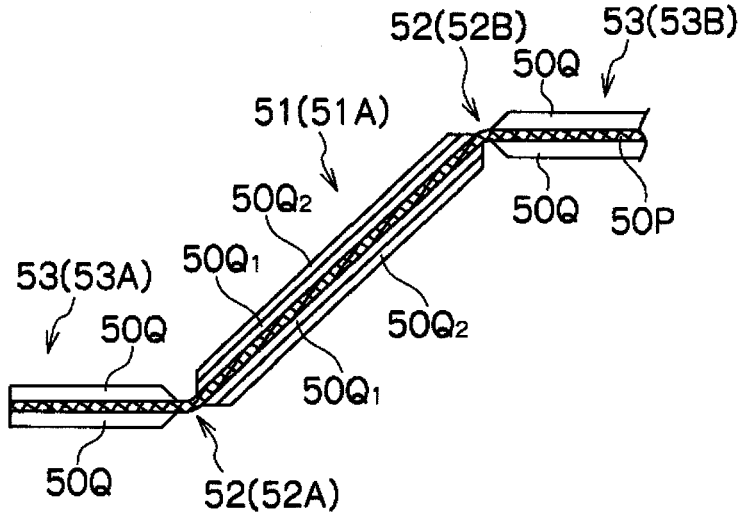

[Vibration Direction Converter Part: FIGS. 8 to 10]

FIG. 8 is a view illustrating a configuration example and operation of the vibration direction converter part 50. A rigid vibration direction converter part 50, direction-converting the vibration of the voice coil 30 and transmitting the vibration to the diaphragm 10, forms hinges 52 on the sides of the diaphragm 10 and the voice coil 30 respectively, having a link part 51 obliquely disposed with respect to the vibration direction of the voice coil 30. The hinges 52 are parts rotatably joining two rigid members or bendably or foldably joining two rigid integrated parts, and the link part 51 is a rigid part having the hinges 52 formed at the ends. Rigidity means that it is hardly deformed, but does not mean that it is totally undeformable. The link part 51 may be formed in a plate shape or a rod shape.

In the embodiment shown in FIG. 8, a plurality of link parts 51 include a first link part 51A, a second link part 51B, a third link part 51C and a fourth link part 51D. The first link part 51A is formed between a hinge 52A at one side of opposing ends of a pair of voice coils $\mathbf{30}_1$ and $\mathbf{30}_2$ and a hinge 52B at one side of a pair of the diaphragm $\mathbf{10}_1$ and $\mathbf{10}_2$. The second link part 51B is formed between a hinge 52D at the other side of opposing ends of a pair of voice coils $\mathbf{30}_1$ and $\mathbf{30}_2$ and a hinge 52C at one side of a pair of the diaphragm $\mathbf{10}_1$ and $\mathbf{10}_2$ The third link part 51C is formed between a hinge 52A at one side of opposing ends of a pair of voice coils $\mathbf{30}_1$ and $\mathbf{30}_2$ and a hinge 52E at the other side of a pair of the diaphragm $\mathbf{10}_1$ and $\mathbf{10}_2$. The fourth link part 51D is formed between a hinge 52D at the other side of opposing ends of a pair of voice coils $\mathbf{30}_1$ and $\mathbf{30}_2$ and a hinge 52F at the other side of a pair of the diaphragm $\mathbf{10}_1$ and $\mathbf{10}_2$.

And, the first link part 51A and the fourth link part 51D are arranged in parallel, the second link 51B and the third link 51C are arranged in parallel, and all of the link parts 51A to 51D are of the same length. A rigid coupling part 53 is formed between the hinges 52B and 52C on the side of the diaphragm, and a rigid coupling part 53 is formed between the hinges 52E and 52F.

FIG. 8(*a*) is a view illustrating the link parts 51 (51A, 51B, 51C, 51D) are in a middle position of vibration. The link part 51 is obliquely disposed at angle $\theta_0$ between the voice coils $30_1$, $30_2$ (voice coil support parts $40_1$ and $40_2$) and the diaphragms $10_1$, $10_2$ (not shown). The hinges 52B, 52C and hinges 52E, 52F on the side of the diaphragm are arranged at position $Z_o$ apart from the voice coils $30_1$, $30_2$ by distance $H_o$ in the vibration direction of the diaphragm $10_1$, $10_2$. The voice coils $30_1$, $30_2$ (voice coil support parts $40_1$, $40_2$) are restricted to vibrate in one axis direction (for example, X-axis direction) and the diaphragms $10_1$, $10_2$ are restricted to vibrate in a direction (for example Z-axis direction) different from the vibration direction of the voice coils $30_1$, $30_2$ As shown in FIG. 8(*b*), when the hinges 52A and 52D formed at opposing ends of the voice coils $30_1$, $30_2$ move in the vibration direction (X-axis direction or −X-axis direction) by $\Delta X_1$ from the original position $X_o$ to position $X_1$, the inclination angle of the link parts 51 (51A, 51B, 51C, 51D) is converted to $\theta_1$ ($\theta_0>\theta_1$), and the hinges 52B, 52C and the hinges 52E, 52F on the sides of the diaphragms move by $\Delta Z_1$ to position $Z_1$ in the vibration direction (Z-axis direction or −Z-axis direction) of the diaphragm $10_1$, $10_2$.

As shown in FIG. 8(*c*), when the hinges 52A and 52D formed at opposing ends of the voice coils $30_1$, $30_2$ move in the vibration direction (−X-axis direction or X-axis direction) by $\Delta X_2$ from the original position $X_0$ to position $X_2$, the inclination angle of the link parts 51 (51A, 51B, 51C, 51D) is converted to $\theta_2$ ($\theta_0<\theta_2$), and the hinges 52B, 52C and the hinges 52E, 52F on the sides of the diaphragms move by $\Delta Z_2$ to position $Z_2$ in the vibration direction (Z-axis direction or −Z-axis direction) of the diaphragm $10_1$, $10_2$.

As such, the vibration direction converter part 50, including the link parts 51 (51A, 51B, 51C, 51D) and the hinges 52 (52A, 52B, 52C, 52D, 52E, 52F), has functions to convert the vibration of the voice coils $30_1$, $30_2$, moving near or away from each other, to an angle-change of the link parts 51 (51A, 51B, 51C, 51D) and to transmit the vibration to the diaphragms $10_1$, $10_2$, and to concurrently vibrate the diaphragms $10_1$, $10_2$ in a direction different from the vibration direction of the voice coils $30_1$, $30_2$.

FIGS. 9 and 10 are views illustrating a formation example of the vibration direction converter part 50 (FIG. 9(*a*) is a side view and FIG. 9(*b*) is a perspective view). The vibration direction converter part 50 includes the link parts 51 (51A, 51B, 51C, 51D) and the hinges 52 (52A, 52B, 52C, 52D, 52E, 52F) formed at both ends as described above. In the example shown in the drawings, a coupling part 53 (53A) is formed at one side of the link parts 51 (51A, 51B, 51C, 51D) via the hinge 52, and a coupling part 53 (53B) is formed at the other side of the link parts 51 (51A, 51B, 51C, 51D) via the hinge 52. The coupling part 53A is a part coupled to the voice coils $30_1$, $30_2$ or the voice coil support parts $40_1$, $40_2$, integrally vibrating with the voice coils $30_1$, $30_2$, and the coupling part 53B is a part coupled to the diaphragms $10_1$, $10_2$, integrally vibrating with the diaphragms $10_1$, $10_2$.

This vibration direction converter part 50 has the link part 51, the hinge 52 and the coupling part 53 integrally formed. The coupling part 53A (on the side of the voice coil $30_1$), the hinge 52A, the link part 51A, the hinge 52B, the coupling part 53B (on the side of the diaphragm $10_1$), the hinge 52C, the link part 51B, hinge 52D and the coupling part 53A (on the side of the voice coil $30_2$) are formed in one member, while the coupling part 53A (on the side of the voice coil $30_1$), the hinge 52A, the link part 51C, the hinge 52E, the coupling part 53B (on the side of the diaphragm $10_2$), the hinge 52F, the link part 51D, the hinge 52D and the coupling part 53A (on the side of the voice coil $30_2$) are formed in one member.

The hinges 52 (52A, 52B, 52C, 52D, 52E, 52F) are formed with a bendable continuous member continuing between the parts at both sides of the hinge 52. This continuous member may be a member forming both the link part 51 and the coupling part 53 or may be a member forming a part of the link part 51 and the coupling part 53.

If the vibration direction converter part 50 is formed with a plate shape member, the hinge 52 is linearly formed extending in a width direction as shown in FIG. 9(*b*). Further, since the link parts 51 are required to be rigid and the hinges 52 are required to be bendable, the integrated member is configured to have different properties by forming the hinges 52 thinner in thickness than the link parts 51 or the coupling parts 53.

Further, change of thickness from the link parts 51 to the hinges 52 is made in the form of slant surface, and the end faces of both parts sandwiching the hinge 52 form slant surfaces 51*t* and 53*t* facing each other. As such, it is possible to prevent the thickness of the link parts 51 from interfering angle variation, when the link parts 51 are angle varied.

In examples shown in FIG. 10, the link parts 51 or the coupling parts 53 are formed by integrating a bendable continuous member and a rigid member, and the hinge parts 52 are parts that are formed only with the continuous member. In the example shown in FIG. 10(*a*), the link parts 51 or the coupling parts 53 are formed by joining a rigid material 50Q to the surface of a continuous member 50P that is a bendable sheet-shaped member. According to this formation, the continuous member 50P continues between the parts at both sides of the hinge parts 52, and the hinge parts 52 are bendably formed only by the continuous member 50P. Meanwhile, the link parts 51 or the coupling parts 53, which are formed by joining the rigid material 50Q to the continuous member 50P, are formed as rigid parts.

In an example shown in FIG. 10(*b*), the rigid material 50Q is joined to sandwich the continuous member 50P to form the link parts 51 or the coupling parts 53. Also, the part, not joined by the rigid material 50Q, becomes the hinge parts 52. In an example shown in FIG. 10(*c*), the rigid material forming the link parts 51 is formed in multiple layers laminated by the rigid materials 50Q1 and 50Q2. Further, in FIG. 10(*c*), the multiple layers laminated by the rigid material 50Q1 and the rigid material 50Q2 may be formed in a single layer. As such, the bendable hinge parts 52 and the rigid link parts 51 and coupling parts 53 may be integrally formed by partially joining the rigid material 50Q to the bendable continuous member 50P.

The continuous member 50P is preferably configured to have intensity and durability durable against repeated bending of the hinge parts 52 when the speaker unit is driven, and have flexibility making no noise when the bending is repeated. According to one embodiment, the continuous member 50P may be formed with a woven or unwoven material made of high-strength fiber. As examples of the woven material, plain weave fabrics with uniform material, plain weave fabrics with warp and weft threads made of different materials respectively, plain weave fabrics with alternately changed thread materials, plain weave fabrics with twisted union yarn and plain weave fabrics by basket weaving, etc. may be included. And, triaxial woven fabrics, multi-axial woven fabrics, triaxial and multiaxial "SOF", knit and one directional basket woven fabrics, etc may be included other than plain weave fabrics.

When the high-strength fiber is applied partially or as a whole, sufficient intensity against vibration of the voice coils 30 or the voice coil support parts 40 may be achieved by arranging the high-strength fiber in the vibration direction of the voice coil support parts 40. When applying both the warp and the weft thread to the high-strength fiber, durability may be improved with a uniform tensile force applied to the warp and the weft thread by inclining both fiber directions by 45° with respect to the vibration direction of the voice coil support parts 40. As the high-strength fiber, aramid fiber, carbon fiber, glass fiber, etc may be used. Further, a damping material may be applied to adjust physicality such as bending stress or rigidity of the continuous member.

As the rigid material 50Q, thermoplastic resin, thermosetting resin, metal, paper, etc., which are light-weight, easy to mold and having rigidity after hardening, may be preferably used. The vibration direction converter part 50 may be configured by joining the rigid material 50Q, which is molded in a plate shape, to the surface of the continuous member 50P other than the part of the hinge parts 52 by using adhesive as a joining material. Further, if thermosetting resin is used as the rigid material 50Q, the vibration direction converter part 50 may be configured by partially impregnating the link parts 51 or the coupling parts 53 of the fibrous continuous member 50P with resin and then hardening it. Further, if resin or metal is used as the rigid material 50Q, the continuous member 50P and the rigid material 50Q may be integrated at the link parts 51 and the coupling parts 53 by applying insert molding.

Figure 11:
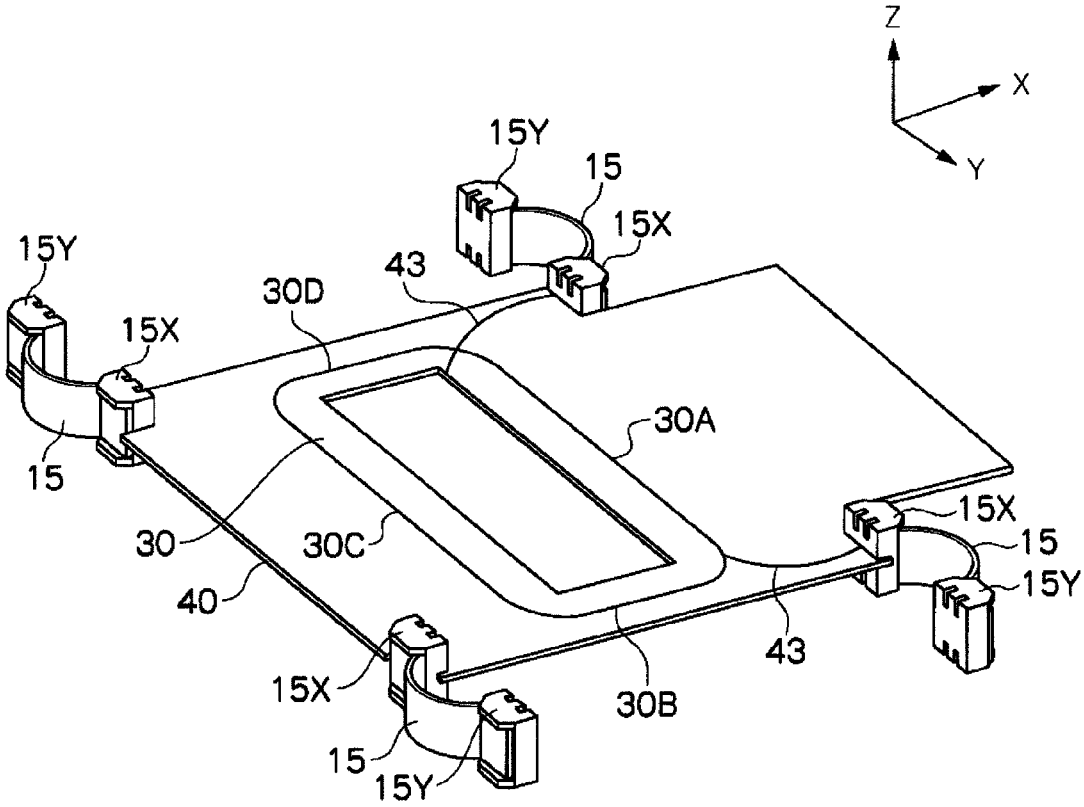
FIG. 11 is a view illustrating an example of a holding mechanism of a voice coil support part with a holding part.

[Holding Part (Damper): FIG. 11]

The holding part 15 holds the voice coils 30 or the voice coil support parts 40 in a prescribed position in the magnetic gap 20G such that the voice coils 30 do not contact the magnetic circuit 20, and supports the voice coils 30 or the voice coil support parts 40 to linearly vibrate in the vibration direction (X-axis direction). This holding part 15 restricts the voice coil support parts 40 not to move in directions, for example, Z-axis direction or Y-axis direction, other than the vibration direction of the voice coil support parts 40. The holding part 15 may be formed with a curved plate member, which is deformable in the vibration direction of the voice coils 30, has rigidity in a direction crossing the vibration direction.

FIG. 11 is a view illustrating one embodiment of a holding mechanism of the voice coil support parts 40 by holding part 15. Although the voice coil support part 40 is held in this embodiment, the voice coil 30 may be directly held. The holding part 15, for example, made of conducting metal, is electrically connected to the end of the voice coils 30 or a voice coil lead wire 43 extending from the end at one end on the side of the voice coil support parts 40, and is electrically connected to an audio signal input terminal at another end on the side of the frame. As described above, the holding part 15 itself may be a vibration wiring made of conducting metal or the holding part 15 may be a wiring substrate (for example, a wiring is linearly formed on the substrate). As described above, the voice coils 30 are planarly formed substantially in a rectangular shape, including linear portions 30A and 30C formed in the Y-axis direction and linear portions 30B and 30D formed in the X-axis direction. The linear portions 30A and 30C of the voice coils 30 are arranged in the magnetic gap 20G of the magnetic circuit 20 and the direction of the magnetic field is prescribed to be in the Z-axis direction.

In the example shown in the drawings, the holding parts 15, being a curved plate member, which allows deformation in one direction along the vibration direction of the voice coil support parts 40 and restricts deformation in other directions, hold the voice coil support parts 40 substantially symmetrically. Further, in the example shown in the drawings, one end of the holding part 15 is mounted on the voice coil support part 40 via the connecting part 15X while the other end is mounted on the frame via the connecting part 15Y. The connecting parts 15X and 15Y are made of insulating material such as resin, and the voice coil lead wire 43 extending from the voice coils 30 is electrically connected to the holding part 15 by soldering, etc., and the holding part 15 is electrically connected to the audio signal input terminal.

Further, these connecting parts 15X and 15Y may be electrical connecting terminals, and the connecting part 15X may be connected to the end of the voice coils 30 or the voice coil lead wire 43 extending from the end, and the connecting part 15Y may be electrically connected to the audio signal input terminal.

Since the lead wire used in the conventional speaker device vibrate when driving the speaker device, the lead wire must be wired in a predetermined space not to contact the members configuring the speaker device, for example, the frame. This is one of the obstacles to prevent the speaker device from being made thin. However, with the lead wire 43 formed on the voice coil support parts 40 as in the example shown in FIG. 11, no predetermined space is required to wire the voice coil lead wire 43, and thereby the speaker device may be made thin.

The other end of the holding part 15 is mounted on the connecting part 15Y, and the connecting part 15Y supports the holding part 15 on the frame such that the voice coil support part 40 vibrates basically in the X-axis direction. Further, with the voice coil lead wire 43, extending to the conductive holding part 15 and electrically connected thereto, disconnection between the voice coil lead wire 43 and the holding part 15 is prevented, and thus reliability of the speaker device may be improved.

The holding part 15, a curved plate member made of conducting metal, allows the movement of the voice coil support parts 40 in the X-axis direction with deformation of the holding part 15, while restricting the movement in the Z-axis direction with high rigidity of the curved plate member. Accordingly, the voice coil support part 40 constantly keeps a predetermined height with respect to the frame in the Z-axis direction. Further, with the substantially symmetrical holding part 15, the voice coil support parts 40 are balanced in the move in the Y-axis direction with an elastic force of the holding part 15, and thus a predetermined position is kept with respect to the frame also in the Y-axis direction.

[Another Embodiment of Speaker Device]

Figure 12A:
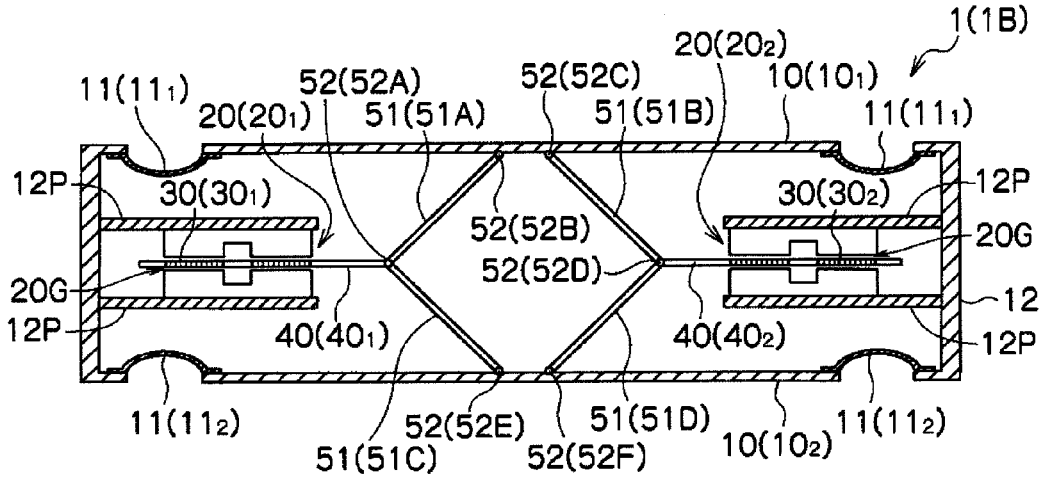
FIGS. 12(*a*)-(*c*) are views illustrating a speaker device according to another embodiment of the present invention.
Figure 12B:
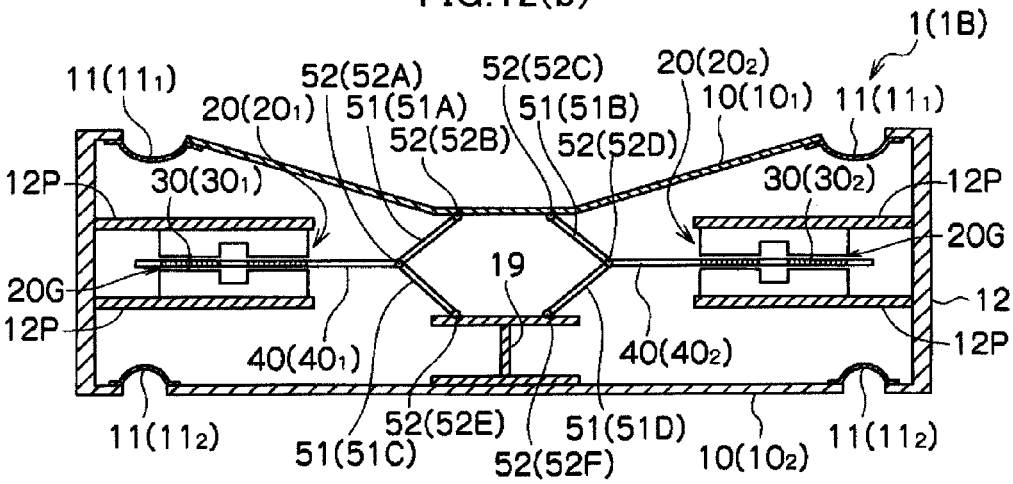
Figure 12C:
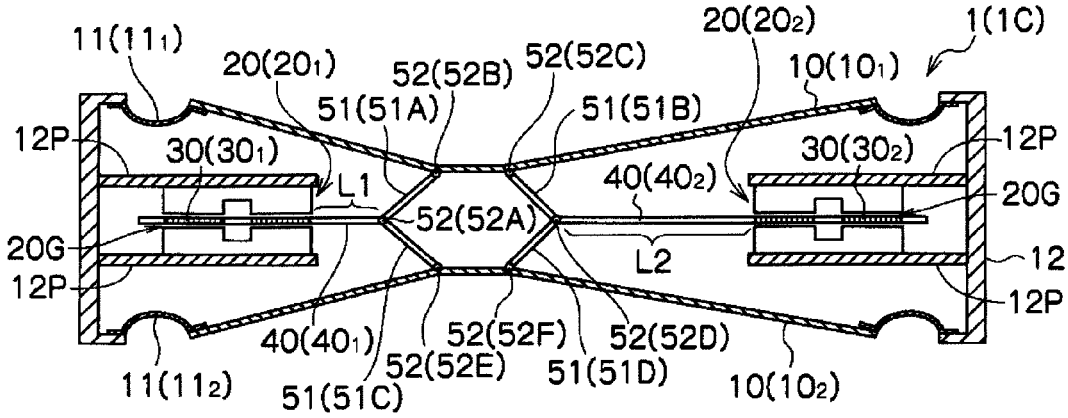
Figure 13A:
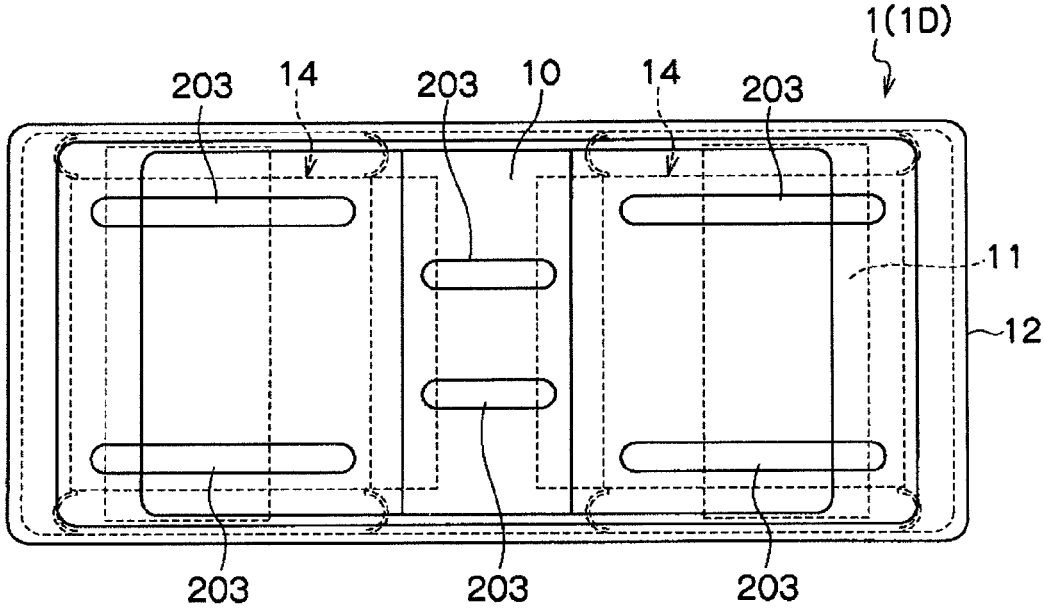
FIGS. 13(*a*) and (*b*) are views illustrating a speaker device according to another embodiment of the present invention.
Figure 13B:
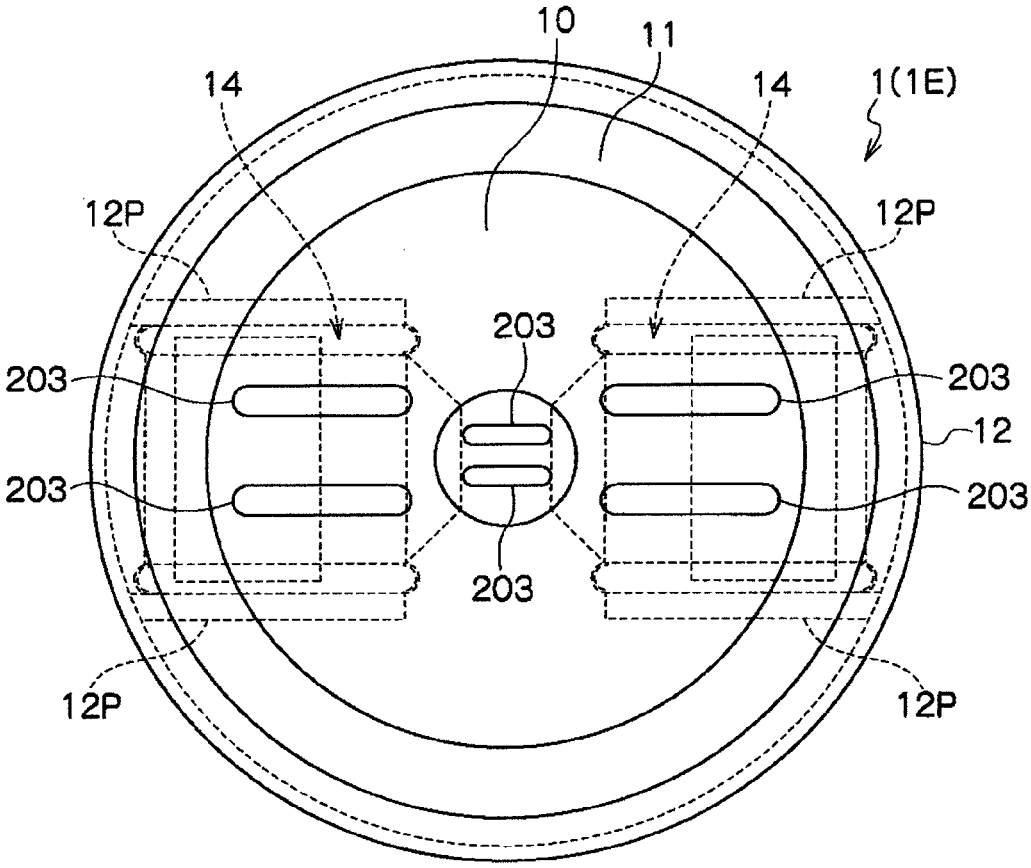

FIGS. 12 and 13 are views illustrating the speaker device according to another embodiment of the present invention (FIG. 12 is a cross-sectional view and FIG. 13 is a plan view). The same symbols are applied to the parts in common with the above-mentioned embodiments, and previous descriptions are cited.

The speaker device 1(1A) shown in FIG. 12(*a*) includes a pair of the substantially tabular diaphragms $\mathbf{10}_1$, $\mathbf{10}_2$, having a substantially tabular cross-section. FIG. 12(*b*) is a cross-sectional view illustrating a pair of the substantially tabular diaphragms $\mathbf{10}_1$, $\mathbf{10}_2$. One of the diaphragms has a linear cross-section, while the other has a substantially V-shaped cross-section. In a pair of the diaphragms $\mathbf{10}_1$, $\mathbf{10}_2$ shown in FIG. 12(*c*), each diaphragm has a V-shaped cross-section. A distance L2 from one of a pair of the magnetic circuits $\mathbf{20}_1$, $\mathbf{20}_2$ to the vibration direction converter part 50 is longer than a distance L1 from the other of a pair of the magnetic circuits $\mathbf{20}_1$, $\mathbf{20}_2$ to the vibration direction converter part 50. Since the distance L1 and the distance L2 are different in dimension, the diaphragms $\mathbf{10}_1$, $\mathbf{10}_2$ may be made asymmetrical, and thus generation of divided resonance may be restrained and reproducing frequency characteristic may be smoothed.

The speaker device 1 (1D, 1E) shown in FIG. 13 has a rib 203 (reinforcing projection) formed on the diaphragm 10 in the vibration direction of the voice coil 30. In the planarly rectangular shaped diaphragm 10 as shown in FIG. 13(*a*) or the planarly substantially circular diaphragm 10 as shown in FIG. 13(*b*), the rib 203 may be formed near the support part of the driving part 14 in the vibration direction of the voice coil 30, whichever is the case. With the rib 203, rigidity of the diaphragm 10 may be increased against vibration of the voice coil 30, and thus even the diaphragm 10 with large area may be integrally vibrated by the driving part 14.

Further, in the above each speaker device 1, a same audio signal is inputted to a plurality of the driving parts 14 driving the diaphragms $\mathbf{10}_1$, $\mathbf{10}_2$ are inputted. Input cords from individual sound sources may be connected to respective voice coils 30, or an input cord from a common sound source may be dividedly connected to each voice coil 30.

Figure 14:
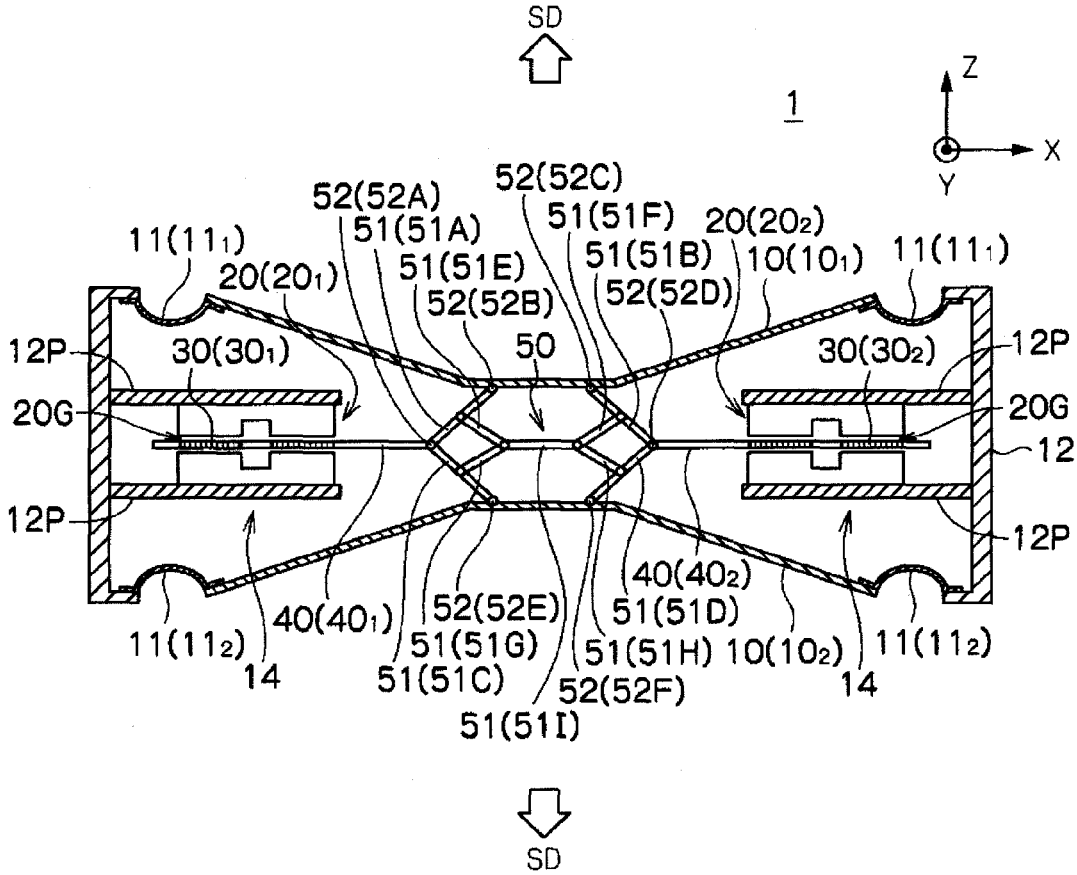
FIG. 14 is a view illustrating a speaker device according to another embodiment of the present invention.

FIG. 14 is a view illustrating another embodiment of the speaker device 1 according to one embodiment of the present invention. In this example, the vibration direction converter part 50 includes a link body having additional link parts 51 (51E to 51I) inside the above-mentioned link parts 51 (51A to 51D). The link parts 51E to 51H have about a half length of the link parts 51A to 51D. Each of one ends of the link parts 51E to 51H forms a hinge at each of the middle parts of the link parts 51A to 51D. The other ends of the link part 51E and the link part 51G are coupled to a hinge while the other ends of the link part 51F and the link part 51H are coupled to another hinge. A link part 51I is provided between the hinge coupling the other ends of the link part 51E and the link part 51G and the hinge coupling the other ends of the link part 51F and the link part 51H. In the above link body, the link parts 51 make angle conversion by receiving a reaction force from the opposite side of the diaphragms $\mathbf{10}_1$, $\mathbf{10}_2$.

As such, the link part 51E and the link part 51G, supporting each other at the other ends, have a function to push up or push down the link parts 51A and 51C with the reaction force, while the link part 51F and the link part 51H, supporting each other at the other ends, have a function to push up or push down the link parts 51B and 51D with the reaction force. Accordingly, when a pair of the voice coils $\mathbf{20}_1$, $\mathbf{20}_2$ vibrate so as to move toward or away from each other, the link parts 51A to 51D are securely angle-converted by a reaction force that the link parts 51E to 51I exert on each other, and thus the pair of the diaphragms $\mathbf{10}_1$, $\mathbf{10}_2$ vibrate with the same amplitude of vibration and in the same phase so as to move toward or away from each other. According to the vibration direction converter part 50 including the link body described as above, the diaphragms $\mathbf{10}_1$, $\mathbf{10}_2$, even if they have no sufficient rigidity, may be concurrently vibrated in directions opposite to each other.

[Advantages of the Speaker Device and its Application Examples]

In the speaker device 1 according to one embodiment of the present invention, since the vibration direction converter part 50 direction-converts the vibration of the voice coil 30 and transmits it to the diaphragm 10, the thickness in the sound emission direction of the speaker device 1 (the total height of the speaker device) may not be large, even if the amplitude of vibration of the diaphragm 10 is made large by increasing the amplitude of vibration of the voice coil 30. As such, a thin speaker device, emitting loud reproduced sound, may be produced.

Further since the vibration direction converter part 50 securely transmits the vibration of the voice coil 30 to the diaphragm 10 with the mechanical link body that is comparatively simply structured, a speaker device with a high reproducing efficiency may be realized while it is made thin, and thus a high-quality reproduced sound may be emitted.

Further, since the rear surface of the diaphragm 10 is supported by a plurality of the driving parts 14 at different positions, it is possible to integrally vibrate the diaphragm 10 even though the diaphragm 10 is made large in area, and thus a high-quality reproduced sound may be emitted restraining divided vibration of the diaphragm 10. In particular, since the large-area diaphragm 10 may effectively emit reproduced sound in low frequencies, it is possible to reproduce a high-quality sound in low frequencies while the speaker device may be made thin and expand reproduction band by lowering a low-frequency reproduction limit.

In addition, when a pair of diaphragms $\mathbf{10}_1$, $\mathbf{10}_2$ opposite each other emit sounds in different directions, the magnetic circuits $\mathbf{20}_1$, $\mathbf{20}_2$ of the driving parts 14, driving the pair of the diaphragms $\mathbf{10}_1$, $\mathbf{10}_2$, may be arranged spaced apart, heat loss of the voice coil 30 due to heat generated by the voice coils $\mathbf{30}_1$, $\mathbf{30}_2$, demagnetization of the magnetic circuit 20, etc. may be restrained. Further, since the magnetic circuits $\mathbf{20}_1$, $\mathbf{20}_2$ may be arranged near the side wall of the frame 12, heat generated by the voice coils $\mathbf{30}_1$, $\mathbf{30}_2$ may be quickly dissipated via the frame 12, and thus both driving parts 14 may be protected against adverse effects due to heat when driving the driving parts 14.

Since a pair of the diaphragms vibrates in directions opposite each other and a pair of the voice coils vibrates in directions opposite each other, reactions due to these vibrations may cancel each other out. As such, there is no trouble of making abnormal noises due to vibration of magnetic circuits, etc. that is caused by reaction of the vibration system. In addition, since reactions of the link parts cancel each other out, vibration of the diaphragm is stabilized, and thus high-quality reproduced sound may be generated.

Figure 15A:
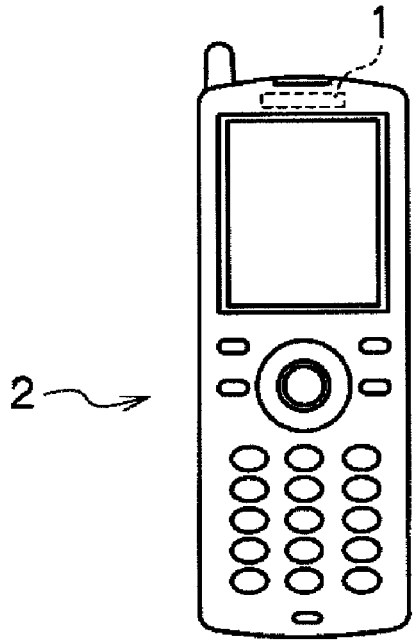
FIGS. 15(*a*) and (*b*) are views illustrating an electronic device that is provided with a speaker device according to an embodiment of the present invention.
Figure 15B:
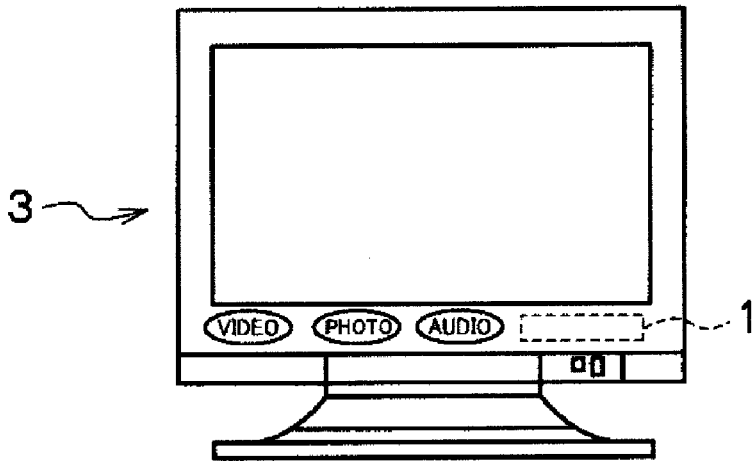
Figure 16:
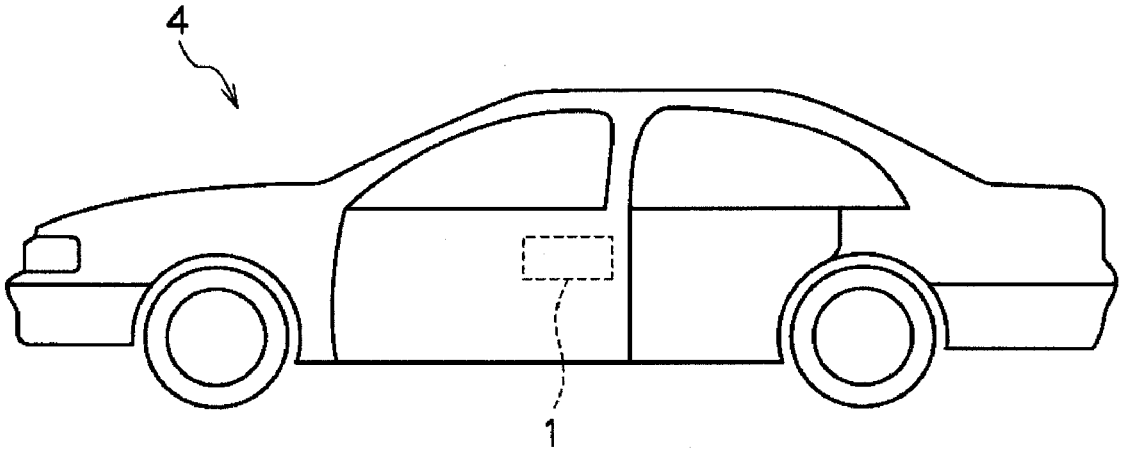
FIG. 16 is a view illustrating an automobile that is provided with a speaker device according to an embodiment of the present invention.

As described above, the speaker device 1, according to the embodiments of the present invention, may be made thin, and may produce louder sound. This speaker device may be effectively applied to various types of electronic devices or in-car devices. FIG. 15 is a view illustrating an electronic device including the speaker device according to one embodiment of the present invention. An electronic device 2 such as a mobile phone or a handheld terminal shown in FIG. 15(*a*) or an electronic device 3 such as a flat panel display shown in FIG. 15(*b*) may have a small housing in thickness required to house the speaker device 1, and thus the whole electric device may be made thin. Further, sufficient audio output may be produced even by the electronic device made thin. FIG. 16 is a view illustrating an automobile provided with a speaker according to one embodiment of the present invention. In an automobile 4 shown in FIG. 16, in-car space may be widened with the speaker device 1 made thin. More particularly, the speaker device 1 according to the embodiment of the present invention, if it is applied to an in-car device, may reduce a bulge of a door panel, and thus enabling to widen driver's space. Further, with sufficient audio output, it is possible to enjoy listening to music or radio broadcasting pleasantly in a car even when driving on the noisy highway, etc.

Further when the speaker device 1 is provided in buildings including a residence building or hotel, inn, training facility, etc., capable of accommodating many guests for conference, meeting, lecture, party, etc., installation space in thickness direction required for the speaker device 1 may be reduced, and thus enabling to save space in a room and make effective use of space. Further, a room equipped with audiovisual equipment can be seen in recent years along with prevalence of projector or big-screen TV. On the other hand, there is also seen a living room, etc. used as a theater room with no room equipped with audiovisual equipment. Also in this case, a living room, etc. can be easily converted to a theater room with the speaker devicel while making effective use of space in the living room. More particularly, the speaker device 1 may be arranged, for example, on the ceiling, the wall, etc. in a room.

Although the embodiments according to the present invention are described with reference to the drawings, specific configurations are not limited to these embodiments, and modifications not departing from the subject matter of the present invention are included in the scope of the present invention.

Further, the technology of each embodiment described above can be used by each other, unless specific contradictions or problems are found in their objects, the configurations, etc. Further, the technology in the above each embodiment may be applied to dynamic speaker devices using a tabular voice coil (for example: Ryffel type speaker device, ribbon type speaker device, speaker device with magnetic pole parts arranged on the sound emission side and on the side opposite to the sound emission side of a tabular voice coil) as necessary, and thus the speaker device may be made thin.

In addition, PCT/JP2008/051197 filed on Jan. 28, 2008, PCT/JP2008/068580 filed on Oct. 14, 2008, PCT/JP2008/069480 filed on Oct. 27, 2008 and PCT/JP2009/050764 filed on Jan. 20, 2009, are incorporated by reference into the present application.

The invention claimed is:

1. A speaker device, comprising:

a pair of diaphragms disposed opposite each other, a frame configured to vibratably support an outer periphery of said diaphragms in a vibration direction, and a plurality of driving parts configured to support a rear surface of each of said diaphragms and vibrate said diaphragms in response to an audio signal, wherein said plurality of said driving parts include:

a pair of magnetic circuits in which a magnetic gap is formed in a direction different from the vibration direction of said diaphragms, a pair of voice coils vibratably arranged in said magnetic gap in one axis direction, vibrating so as to move toward or away from each other in response to said audio signal, and a rigid vibration direction converter part direction-converting the vibration of said voice coils and transmitting the vibration to said diaphragms, and said rigid vibration direction converter part has a hinge formed on a side of said pair of diaphragms and on a side of the opposing ends of said pair of voice coils, respectively, and a link part obliquely disposed with respect to the vibration direction of said voice coils.

2. The speaker device according to claim 1, wherein a plurality of said link parts are configured to be of the same length.

3. The speaker device according to claim 1, wherein a rigid coupling part is formed between a pair of hinges formed on the side of said each of said diaphragms, and the coupling part is coupled to said diaphragms.

4. The speaker device according to claim 1, wherein either one or both of said pair of the diaphragms has a substantially V-shaped cross section.

5. The speaker device according to claim 1, wherein either one or both of said pair of the diaphragms has a substantially tabular cross section.

6. The speaker device according to claim 1, wherein one of said pair of the diaphragms has a substantially V-shaped cross-section while the other has a substantially tabular cross section.

7. The speaker device according to claim 1, wherein said diaphragms have a substantially circular planar shape or a substantially ellipsoidal planar shape.

8. The speaker device according to claim 1, wherein said diaphragms have a substantially rectangular planar shape.

9. The speaker device according to claim 1, wherein said magnetic circuits are spaced apart from each other and are arranged near a side wall of said frame.

10. The speaker device according to claim 9, wherein said magnetic circuit is attached to an attaching portion elongatedly formed from the side wall of said frame to a center side.

11. The speaker device according to claim 10, wherein said voice coils are vibratably supported by a support part.

12. The speaker device according to claim 1, wherein a distance from one of said pair of magnetic circuits to said rigid vibration direction converter part is longer than a distance from the other of said pair of magnetic circuits to said rigid vibration direction converter part.

13. The speaker device according to claim 1, wherein said magnetic circuit has a pair of magnetic gaps in which magnetic fields are formed in directions opposite each other, arranged in the vibration direction of said voice coils, and said voice coils are planarly and annularly formed such that electric current flows in directions opposite to each other in said pair of magnetic gaps.

14. The speaker device according to claim 1, wherein said voice coils are arranged in said pair of magnetic gaps, having a linear portion crossing the vibration direction of the voice coils.

15. The speaker device according to claim 1, wherein a holding part is provided to vibratably hold said voice coils on said frame in the vibration direction and to prevent said voice coils from moving in other directions.

16. The speaker device according to claim 15, wherein said holding part is deformable in the vibration direction of said voice coils and is formed with a curved plate member having rigidity in a direction crossing the vibration direction.

17. The speaker device according to claim 1, wherein said rigid vibration direction converter part is formed with a plate shape member having a linear bending part, and said bending part is said hinge.

18. The speaker device according to claim 1, wherein said link part includes:

a first link part arranged between one end of the opposing sides of said pair of voice coils and one end of said pair of diaphragms, a second link part formed between the other end of the opposing sides of said pair of voice coils and one end of said pair of diaphragms, a third link part formed between one end of the opposing sides of said pair of voice coils and the other end of said pair of diaphragms, and a fourth link part formed between the other end of the opposing sides of said pair of voice coils and the other end of said pair of diaphragms, and said first link part and said fourth link part are arranged in parallel to each other while said second link part and said third link part are arranged in parallel to each other, and all of said link parts have the same length.

19. The speaker device according to claim 1, wherein said rigid vibration direction converter part has one end angle-variably coupled to said voice coils directly or via a first coupling member, while the other end is coupled to said diaphragms directly or via a second coupling member, and said rigid vibration direction converter part is obliquely arranged with respect to both the vibration direction of said diaphragms and the vibration direction of said voice coils.

20. The speaker device according to claim 1, wherein said rigid vibration direction converter part is provided with a link body that angle-converts the link part parts formed between said voice coils and said diaphragms.

21. The speaker device according to claim 20, wherein said link body angle-converts said link part, which receive a reaction force from the opposite side of said diaphragms.

22. An automobile comprising the speaker device according to claim 1.

23. An electronic device comprising the speaker device according to claim 1.

24. A building comprising the speaker device according to claim 1.

25. The speaker device according to claim 1, wherein a plurality of link parts are symmetrically arranged with respect to two axes of the vibration direction of said voice coils and the vibration direction of said diaphragm.

* * * * *